US008667902B2

(12) United States Patent
Linde

(10) Patent No.: US 8,667,902 B2
(45) Date of Patent: Mar. 11, 2014

(54) RAILWAY WAGON AND A METHOD OF ITS LOADING

(75) Inventor: Peter Linde, Limhamn (SE)

(73) Assignee: K Technology AB, Malmo (SE)

( * ) Notice: Subject to any disclaimer, the term of this patent is extended or adjusted under 35 U.S.C. 154(b) by 189 days.

(21) Appl. No.: 13/259,427

(22) PCT Filed: Apr. 14, 2010

(86) PCT No.: PCT/SE2010/050403

§ 371 (c)(1),
(2), (4) Date: Sep. 23, 2011

(87) PCT Pub. No.: WO2010/120236

PCT Pub. Date: Oct. 21, 2010

(65) Prior Publication Data

US 2012/0017799 A1 Jan. 26, 2012

(30) Foreign Application Priority Data

Apr. 16, 2009 (SE) ..... 0950249
Oct. 26, 2009 (SE) ..... 0950793

(51) Int. Cl.
*B61D 3/04* (2006.01)

(52) U.S. Cl.
USPC ..... 105/355; 105/455

(58) Field of Classification Search
USPC ..... 105/4.1, 355, 370, 455; 414/481, 482, 414/812
See application file for complete search history.

(56) References Cited

U.S. PATENT DOCUMENTS

| | | | | |
|---|---|---|---|---|
| 3,548,756 | A | 12/1970 | Fujioka | |
| 3,581,918 | A * | 6/1971 | Fujioka | 414/395 |
| 5,853,280 | A | 12/1998 | Lohr | |
| 5,988,073 | A | 11/1999 | Eriksson | |
| 6,095,055 | A | 8/2000 | Lohr et al. | |
| 2008/0271634 | A1 | 11/2008 | Eriksson | |

FOREIGN PATENT DOCUMENTS

| | | |
|---|---|---|
| DE | 3234374 | 3/1984 |
| EP | 0404037 | 12/1990 |
| EP | 0703134 | 3/1996 |
| GB | 901275 | 7/1962 |
| GB | 1053973 | 1/1967 |

OTHER PUBLICATIONS

International Search Report, corresponding to PCT/SE2010/050403, mailed on May 21, 2010.

* cited by examiner

*Primary Examiner* — Zachary Kuhfuss
(74) *Attorney, Agent, or Firm* — Renner, Otto, Boisselle & Sklar, LLP.

(57) ABSTRACT

A railway wagon for transport of for example a semi-trailer comprises—carried by two bogies or the like—a main portion, pivotally connected to a rearward bogie, and a wagon end, connected to a forward bogie, the main portion and the wagon end being releasably connected to each other. A beam is to be connected to or is connected to the wagon end for horizontally guiding the main portion at its pivoting out from the wagon end. Means are provided for vertically displacing the main portion or a part thereof in relation to the wagon end.

20 Claims, 25 Drawing Sheets

RAILWAY WAGON AND A METHOD OF ITS LOADING

TECHNICAL FIELD

The present invention relates to a railway wagon for transport of for example a semi-trailer, comprising—carried by two bogies or the like—a main portion, pivotally connected to a rearward bogie, and a wagon end, connected to a forward bogie, the main portion and the wagon end being releasably connected to each other. It also relates to a method at a loading of a semitrailer or the like on such a railway wagon.

BACKGROUND OF THE INVENTION

It is well known in the art that in many instances it may be desirable to load a semi-trailer, normally intended for road transport, on a railway wagon and to transport it in a train on a railway so as to provide a more efficient and environmentally tolerable transportation.

The loading and unloading of a semi-trailer on and off a railway wagon, built for this purpose, requires in its simplest form extensive equipment, such as cranes and/or heavy lift trucks, at specialized terminals. Also, the investments in and around such terminals of roads and handling areas are burdensome.

A more favourable solution may be to allow for the possibility to pivot out a loading area for the semi-trailer from the remainder of the wagon, so that the semi-trailer can be rolled onto this loading area, which is then pivoted back in line with the wagon for rail transport.

A typical example of this technique, falling within the definition under the heading Technical Field above, is shown in DE-A-32 34 374. The loading area is here pivoted out from the wagon on rolls or the like on a special ground plate. The investments in the infrastructure are still high.

Another example of the same general nature is shown in EP-A-0 869 891 and EP-A-1 805 072. This wagon suffers from the disadvantages with the infrastructure demands and is furthermore heavy, complicated and expensive.

A relatively early attempt to provide a railway wagon—not falling within the definition above—with a pivotable platform for a semi-trailer or a container is shown in GB-B-901 275. The pivotable movement of the platform is guided by beams on the wagon, and the beams may be pivoted out from the wagon. The platform, supported by support legs, has ramps for the rolling on and off of a semi-trailer.

The main purpose of the invention is to provide a railway wagon of the kind defined above, which does not show the drawbacks described above. Especially, it shall be possible to load and unload a semi-trailer at any desired location without the provision of any special infrastructure in the form of special plates, surfaces or the like.

THE INVENTION

A railway wagon fulfilling the above requirements is according to the invention attained by the combination of a beam to be connected to or being connected to the wagon end for horizontally guiding the main portion at its pivoting out from the wagon end and means for vertically displacing the main portion or a part thereof in relation to the wagon end.

Power is needed for maneuvering the main portion horizontally and vertically. If it is desired to keep the construction of the wagon as simple as possible, this power can be transferred from a power source external to the wagon through the beam. In other cases it may be more favorable to have an internal power source in the wagon for maneuvering the main portion. The power source may be pneumatic, hydraulic or electric.

In a practical case with an external power source a beam assembly comprising the beam and two telescoping support legs can be connected to a working machine or truck, supplying the necessary power. The beam assembly is to be connected to the wagon end, before the main portion can be pivoted out.

In the case with an external power source the beam can be attached to the wagon end and can be connected to a working machine or truck. The working machine or truck may in such a case be provided with a telescoping support leg for the beam.

In the case with an internal power source the beam may be pivotally attached to the wagon end and be provided with a telescoping support leg at its end.

A connection mechanism between the main portion and the wagon end may in a first embodiment comprise the means for vertically displacing the main portion in relation to the wagon end. Such a connection mechanism is preferably arranged at each lateral end of the main portion, so that access for a semi-trailer to the through-shaped main portion with an open end is possible.

Each connection mechanism preferably has means for lifting the main portion somewhat from a locked neutral position in order to unlock the connection mechanism from the wagon end and for lowering the main portion to the ground.

Especially in the case with an internal power source, the main portion may in a second embodiment be provided with telescoping control legs for its support on the ground, when it is pivoted out from the wagon end and disconnected from the beam.

These control legs are preferably arranged in the vicinity of the free end of the main portion and are arranged to lower the main portion to the ground and to lift it again after loading or unloading of a semi-trailer. Alternatively, the control legs are arranged to lower a bottom ramp, pivotally attached to the main portion, to the ground and to lift it again after loading or unloading of a semi-trailer.

As a special embodiment a wagon unit may comprise two wagons on a common Jacobs bogie, constituting the rearward bogie for each of the two wagons. Hereby, a six-axle wagon is created.

A method at a loading of a semi-trailer or the like on a railway wagon as defined above is characterized in that a beam is arranged at or pivoted out from the wagon end in proper position for horizontally guiding the main portion, that the main portion is pivoted out from the wagon end guided by the beam, that the main portion is lowered by means for vertically displacing the main portion or a part thereof in relation to the wagon end, and that the beam is removed or pivoted in against the wagon end for allowing longitudinal entry of the semi-trailer.

If the main portion is provided with telescoping control legs, these are lowered into supporting contact with the ground prior to pivoting in the beam against the wagon end, whereupon the main portion is lowered to the ground by means of the control legs.

BRIEF DESCRIPTION OF THE DRAWINGS

The invention will be described in further detail below under reference to the accompanying drawings, in which.

DESCRIPTION OF EMBODIMENTS

Figure 1:
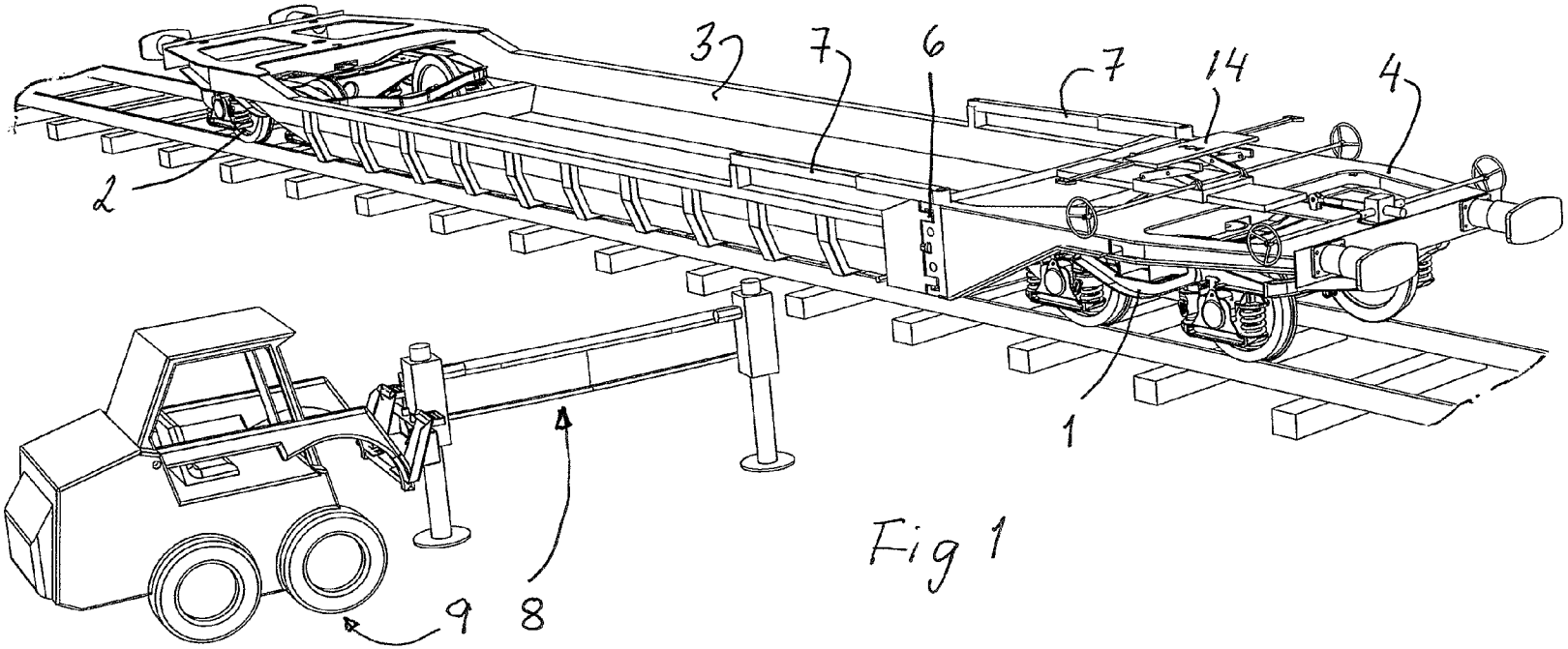
FIG. 1 is an isometric view of a semi-trailer wagon according to a first embodiment of the invention with a beam assembly and a truck for its handling.

A railway wagon for loading a semi-trailer thereon is shown in FIG. 1. The wagon has two bogies (or wheel sets): a forward bogie 1 and a rearward bogie 2. The bogies 1 and 2 support a chassis, comprising a main portion 3 and a wagon end 4. As is first clearly visible in FIG. 4 but then also in many other Figures, the main portion 3 and the wagon end 4 are movable in relation to each other, but in the transport position shown in FIG. 1 they are connected to each other and form an entity (or wagon that can be run on the railway). The main portion 3 is pivotally connected to the rearward bogie 2, whereas the wagon end 4 is pivotally connected to the forward bogie 1.

The main portion 3 is intended to accommodate a semi-trailer 5, shown in FIGS. 10, 11, 24, and 25, and is preferably through-shaped with an open end when pivoted out from the wagon end 4 and with longitudinal sidewalls.

The relative movability of the main portion 3 in relation to the wagon end 4 has the purpose of enabling a rolling loading of the semi-trailer 5 onto the main portion 3 in a position where the main portion 3 is pivoted out from the wagon end 4.

At the arc-shaped junction between the main portion 3 and the wagon end 4 there is a slide arrangement 6 to enable the pivoting movement and locking means to lock the main portion 3 to the wagon end 4 in a transport position. The slide arrangement 6 may as shown comprise three grooves in the wagon end 4 and three projections 6' (FIG. 4) at each end of the main portion 3.

A telescopic strut 7 may be arranged between the main portion 3 and the wagon end 3 at either side of the wagon for preventing breaking between these two portions, when they are pivoted in relation to each other.

In order to enable the pivoting out of the main portion 3 to a position, in which a semi-trailer can be rolled onto the main portion, there is provided in the first embodiment shown in FIGS. 1-11 a beam assembly 8 powered and controlled by a working machine or truck 9, for example of the type Bobcat®.

Figure 2:
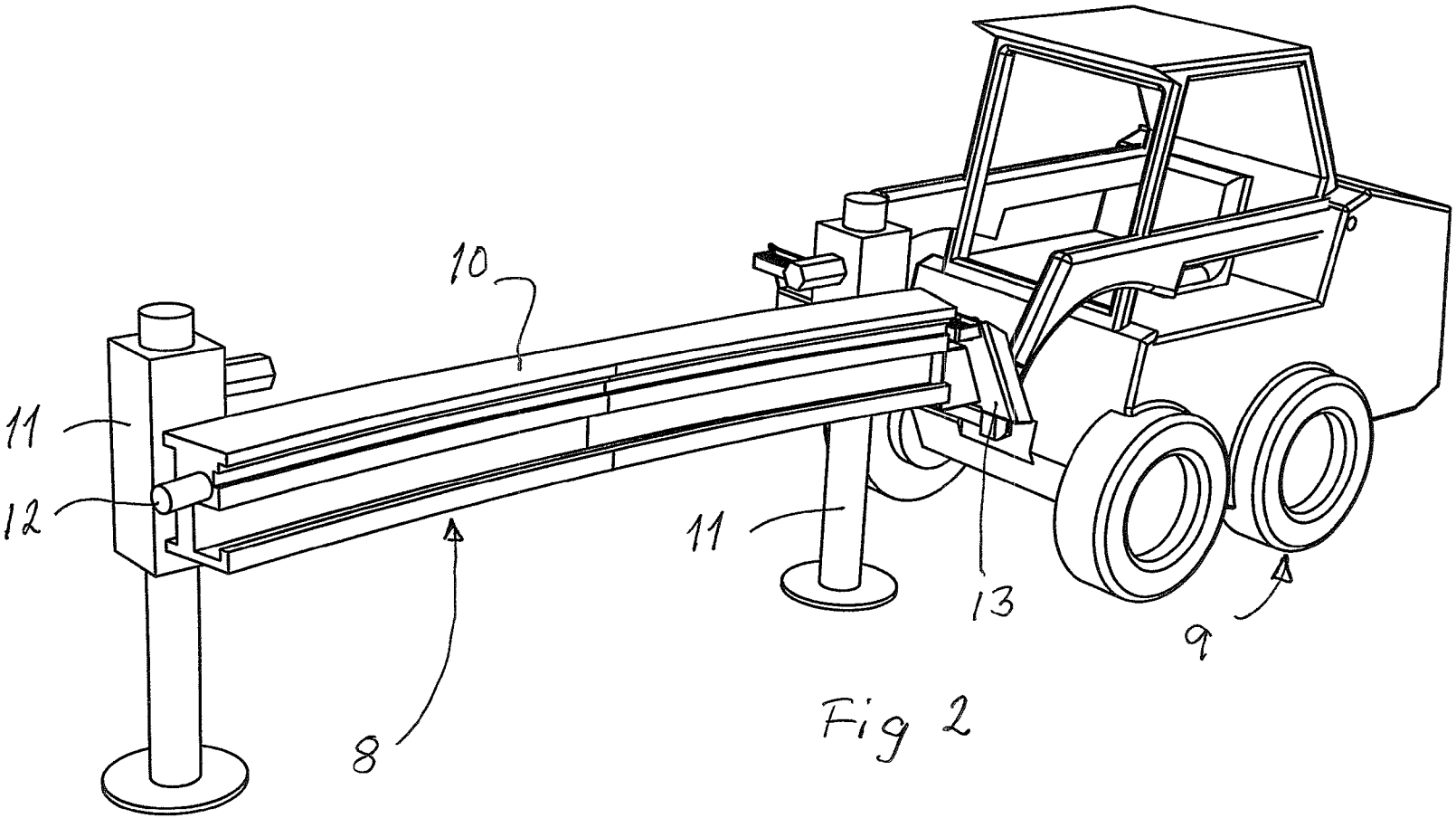
FIG. 2 is an isometric view of a truck and a beam assembly for handling a wagon according to FIG. 1, FIG. 3 corresponds to FIG. 1 but shows a later stage in the handling of the wagon, FIG. 4 also corresponds to FIG. 1 but shows a further handling stage.

As is most clearly shown in FIG. 2, this beam assembly 8 mainly comprises an arc-shaped beam 10 with two telescoping support legs 11 extending perpendicularly thereto. The end to the left in the Figure of the beam 10 may be provided with a guide pin 12 for cooperation with a corresponding hole at the grooves in the wagon end 4. At the opposite end of the beam 10 there are connection means 13 for hydraulic connection between the hydraulic power source of the truck 9 and a hydraulic system in the beam assembly 8.

The support legs 11 may be telescoped to a desired length individually by hydraulic motors therein, or alternatively one of the support legs 11 can have a hydraulic motor and the telescopic movement be synchronously transmitted by mechanical means to the other support leg.

The beam 10 also contains a hydraulically powered driver (not shown) movably longitudinally therein for catching the end of the main portion 3 in a position with the beam 8 in line with the grooves of the wagon end 4 and for transferring the main portion 3 in a pivoting movement along the beam 8.

FIG. 1 illustrates a starting position with the semi-trailer wagon in transport position and the beam assembly 8 connected to the truck 9.

Figure 3:
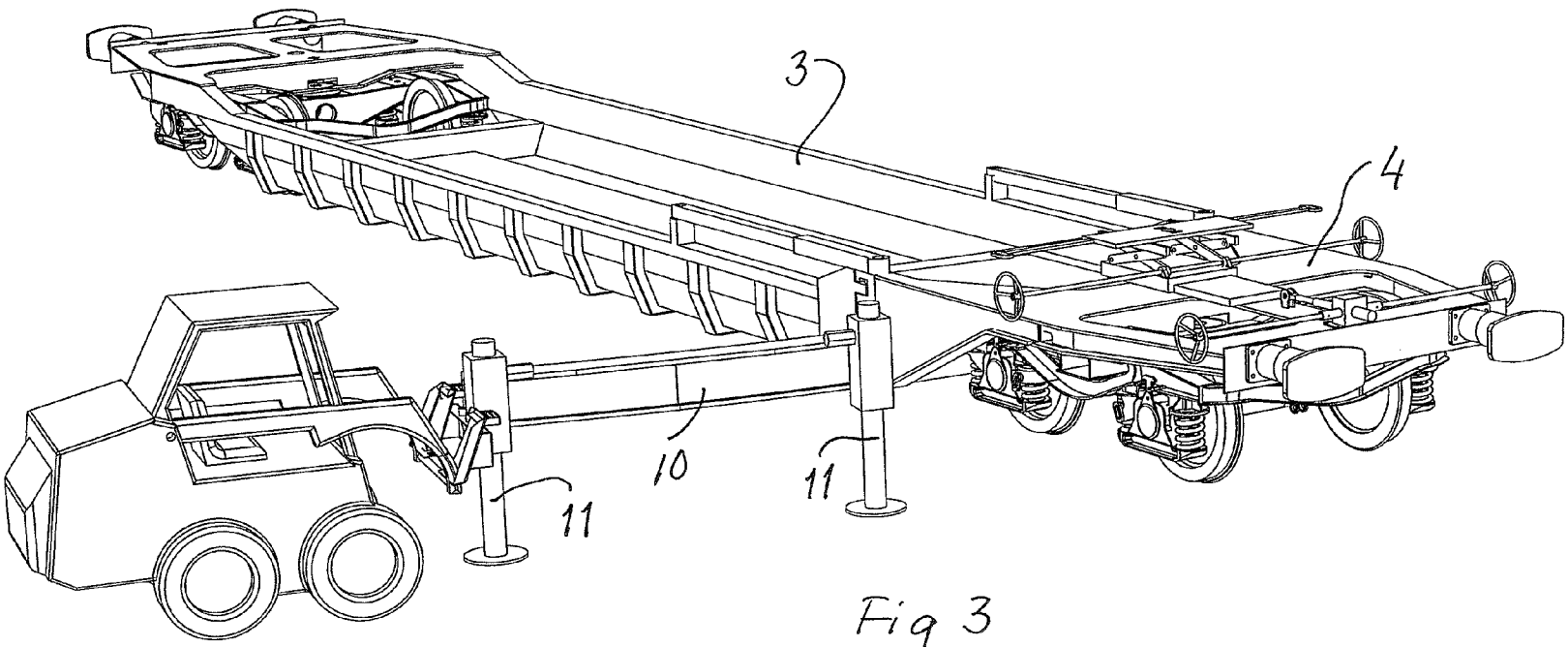

In FIG. 3 the beam 10 has been brought in line with the grooves of the wagon end 4 and has been locked in this position. The support legs 11 have been brought into supporting contact with the ground.

Figure 4:
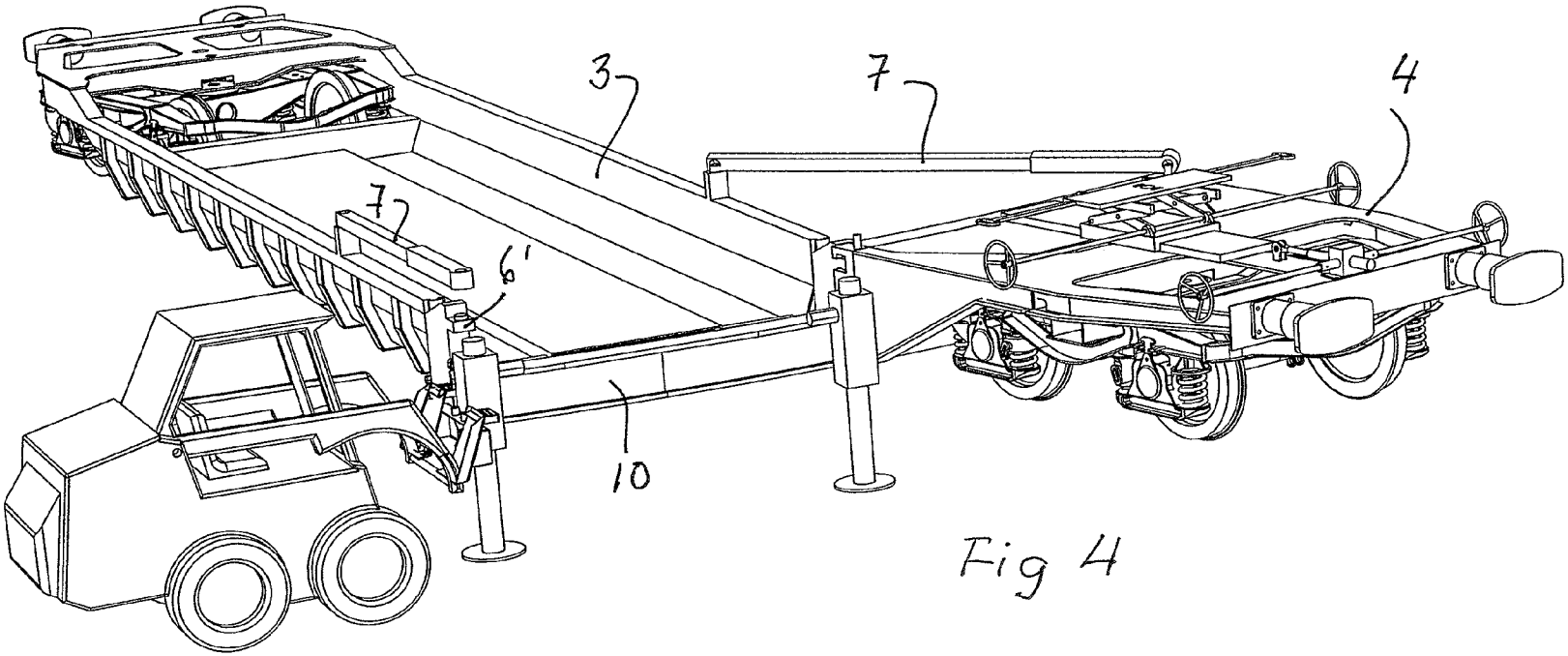

In FIG. 4 the main portion 3 has been pivoted out in the beam 10 (after one of the struts 7 has been disconnected). It may be noted, however, that at the end of this pivoting movement a side portion of the main portion has not left contact with the wagon end 4.

Before this pivoting movement can be accomplished, the main portion 3 has to be disconnected from the wagon end 4. Reference is now made to FIGS. 5-8 for a description of this (and another) feature.

At its end neighboring the wagon end 4, the main portion 3 is provided with a connection mechanism 3A at each side. There are mechanical means—for example hydraulically operated from the truck 9—within the connection mechanism 3A for lifting and lowering the main portion in relation thereto and maintaining the attained positions.

Figure 5:
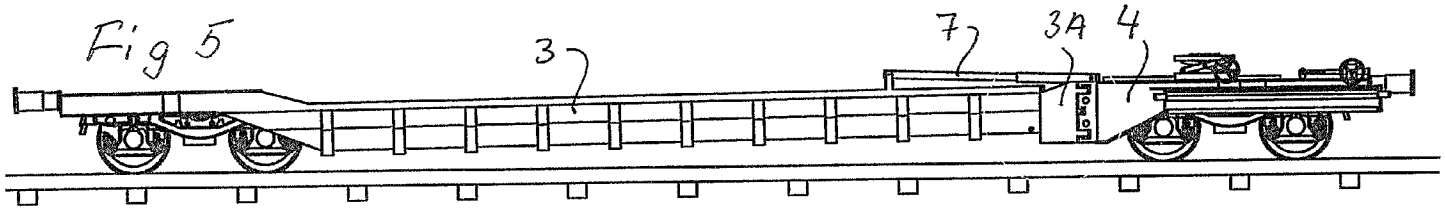
FIG. 5 is a side view of the wagon shown in FIG. 1 with a portion thereof somewhat lifted.
Figure 6:
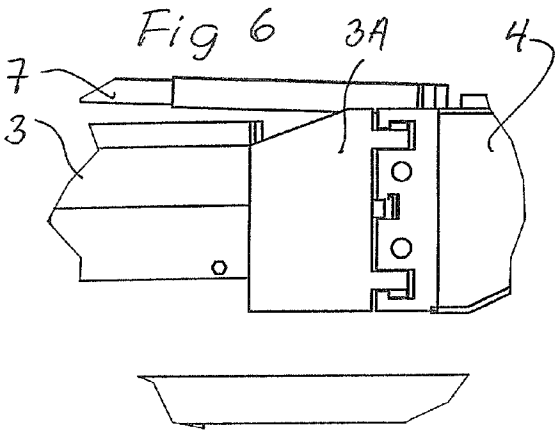
FIG. 6 is a detail view from FIG. 5.

In the stage immediately preceding the one shown in FIG. 4, the main portion 3 is lifted somewhat, as is shown in FIGS. 5 and 6. By this movement, mechanical locking means between the connection mechanisms 3A and the wagon end 4 will be released and the pivoting movement enabled.

When the pivoting movement is completed (FIG. 4), the connected strut 7 will be locked in order to prevent breaking between the main portion 3 and the wagon end 4.

Figure 7:
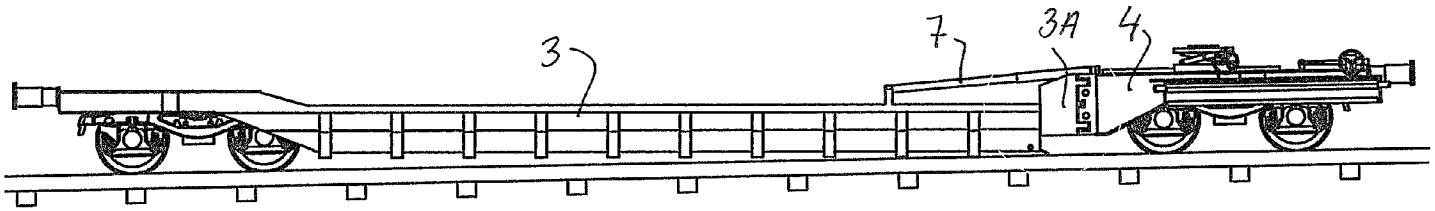
FIG. 7 is a side view of the wagon shown in FIG. 1 with a portion thereof lowered.
Figure 8:
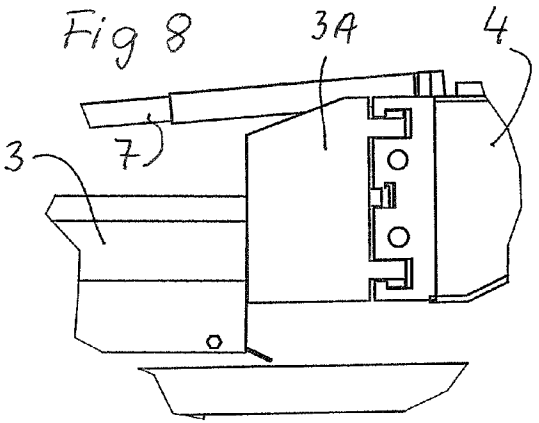
FIG. 8 is a detail view from FIG. 7, FIG. 9 corresponds to FIG. 4 but shows a still further handling stage, FIG. 10 corresponds to FIG. 9 but shows a still further handling stage with a semi-trailer loaded on the wagon, FIG. 11 corresponds to FIG. 10 but shows a final stage with the semi-trailer loaded on the wagon, which is now ready for transfer on a railway.

Hereafter, the main portion 3 is lowered in relation to the connection mechanisms 3A until contact with the ground at the rail, as is shown in FIGS. 7 and 8.

Figure 9:
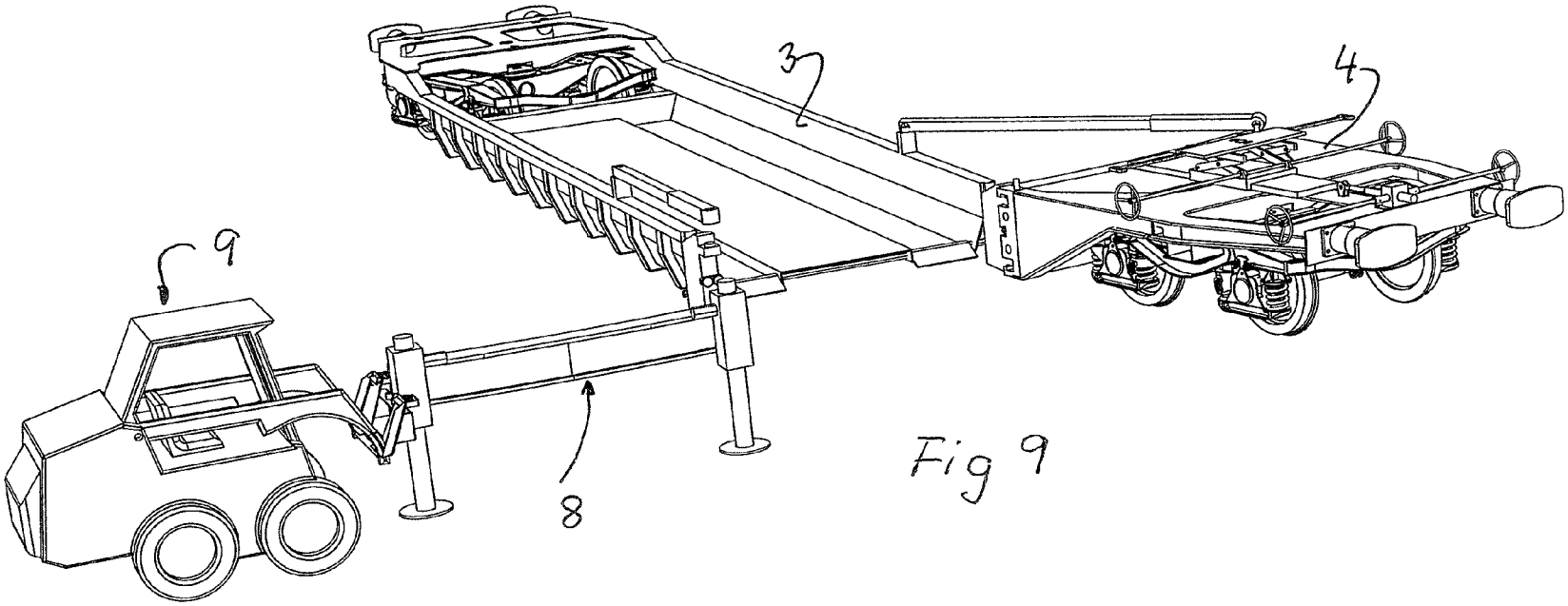

The beam assembly 8 can now be removed by the truck 9, as shown in FIG. 9, leaving the main portion 3 open for backing in a semi-trailer 5 by means of a tractor unit.

Figure 10:
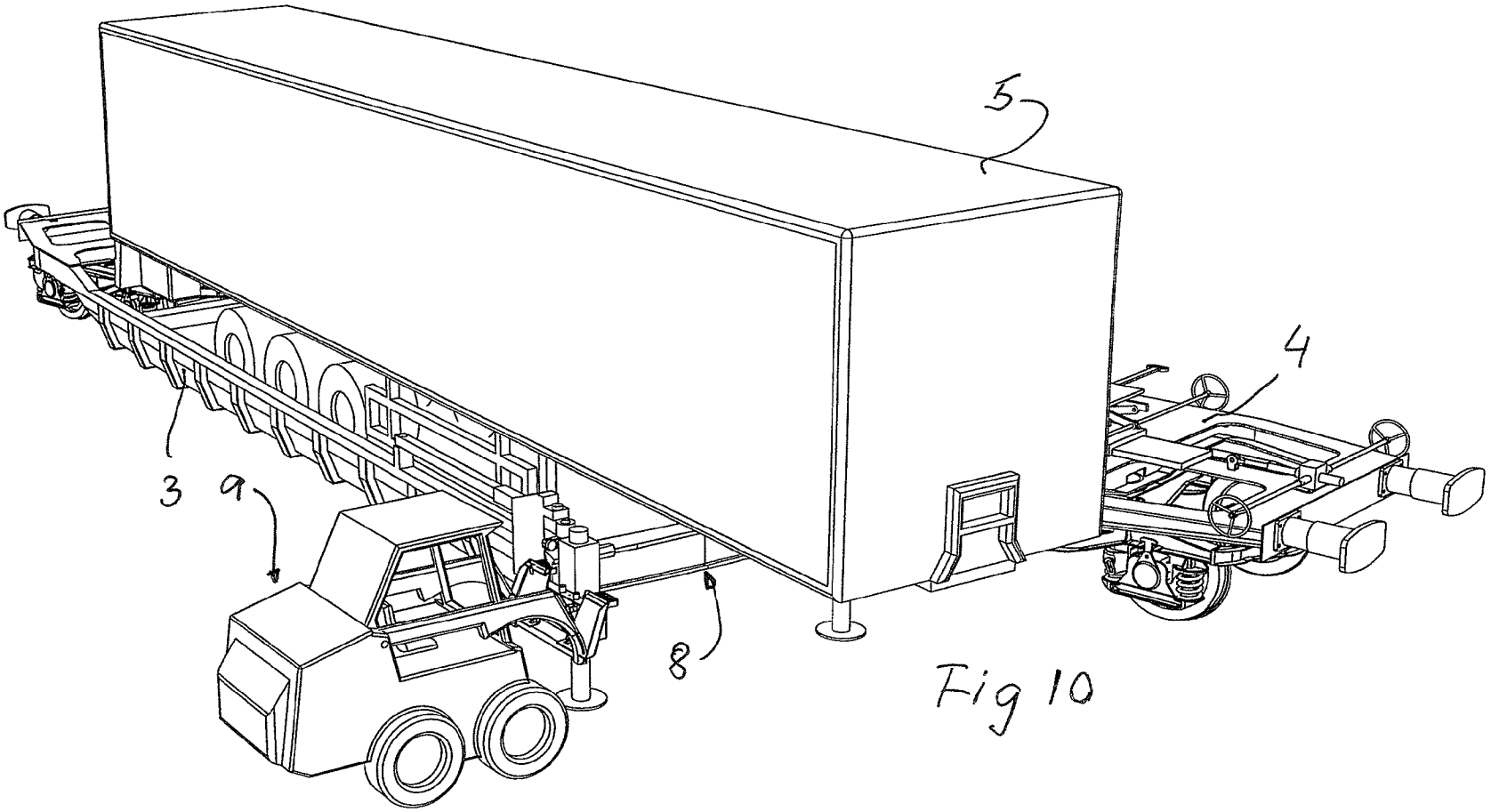

In FIG. 10 the semi-trailer 5 is loaded on the main portion 3 and the beam assembly 8 has again been brought into appropriate position against the wagon end 4 for enabling a return pivoting movement of the main portion 3. The main portion 3 is lifted to the position shown in FIGS. 5 and 6 (some 100 mm over the transport position) and is pivoted into line with the wagon end 4. When the main portion 3 hereafter is lowered into transport position, the connection mechanisms 3A will be locked to the wagon end 4 and the king pin of the semi-trailer will engage an appropriate attachment 14 (FIG. 1) therefore on the wagon end 4.

Figure 11:
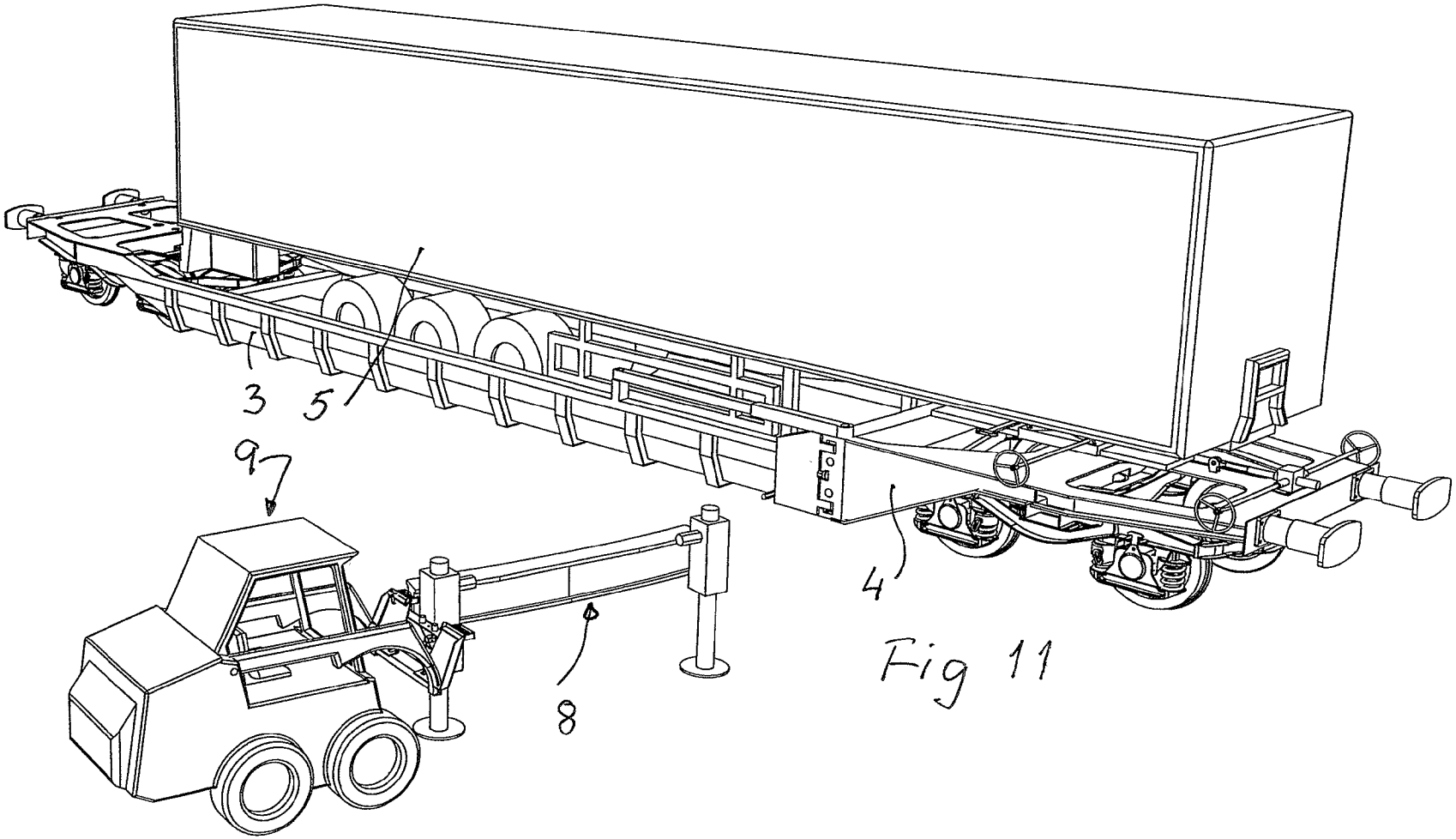

As shown in FIG. 11, the semi-trailer wagon is now ready for transport on its rail. An unloading process of the semi-trailer is performed in a corresponding but generally opposite way.

A second embodiment is shown in FIGS. 12-15.

Figure 12:
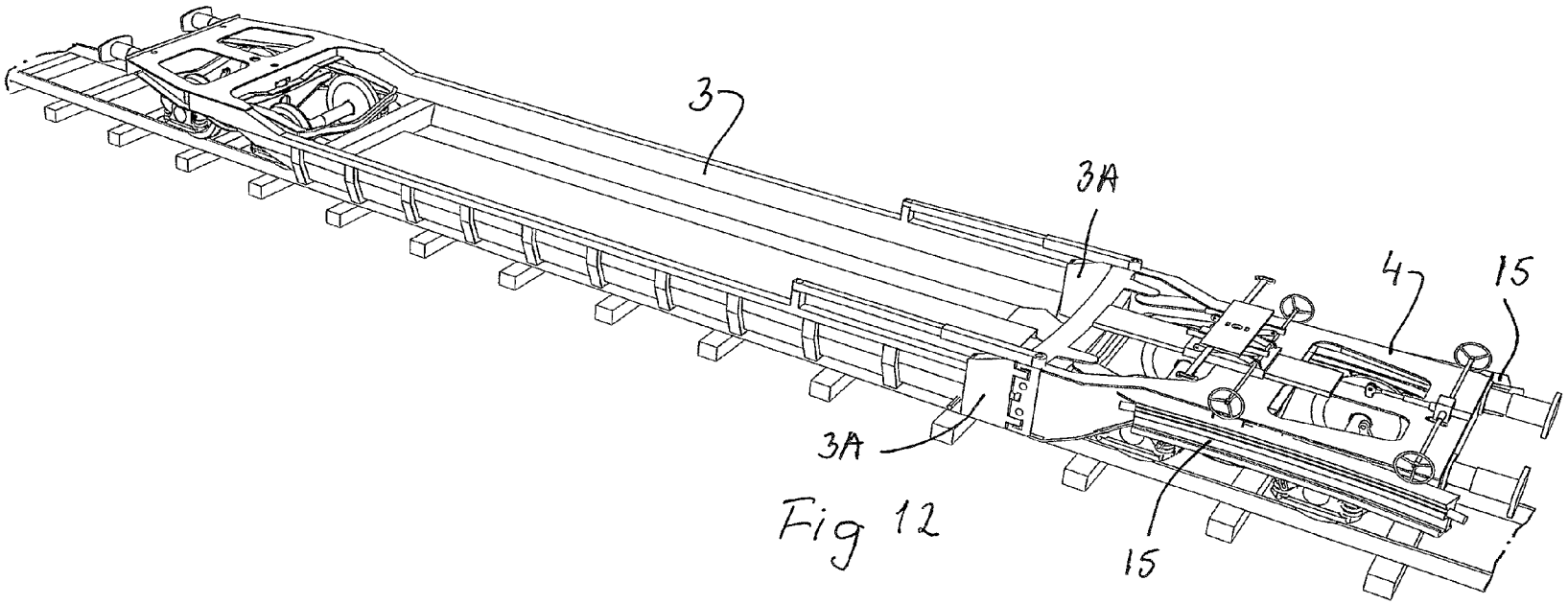
FIG. 12 is an isometric view of a semi-trailer wagon according to a second embodiment of the invention.
Figure 13:
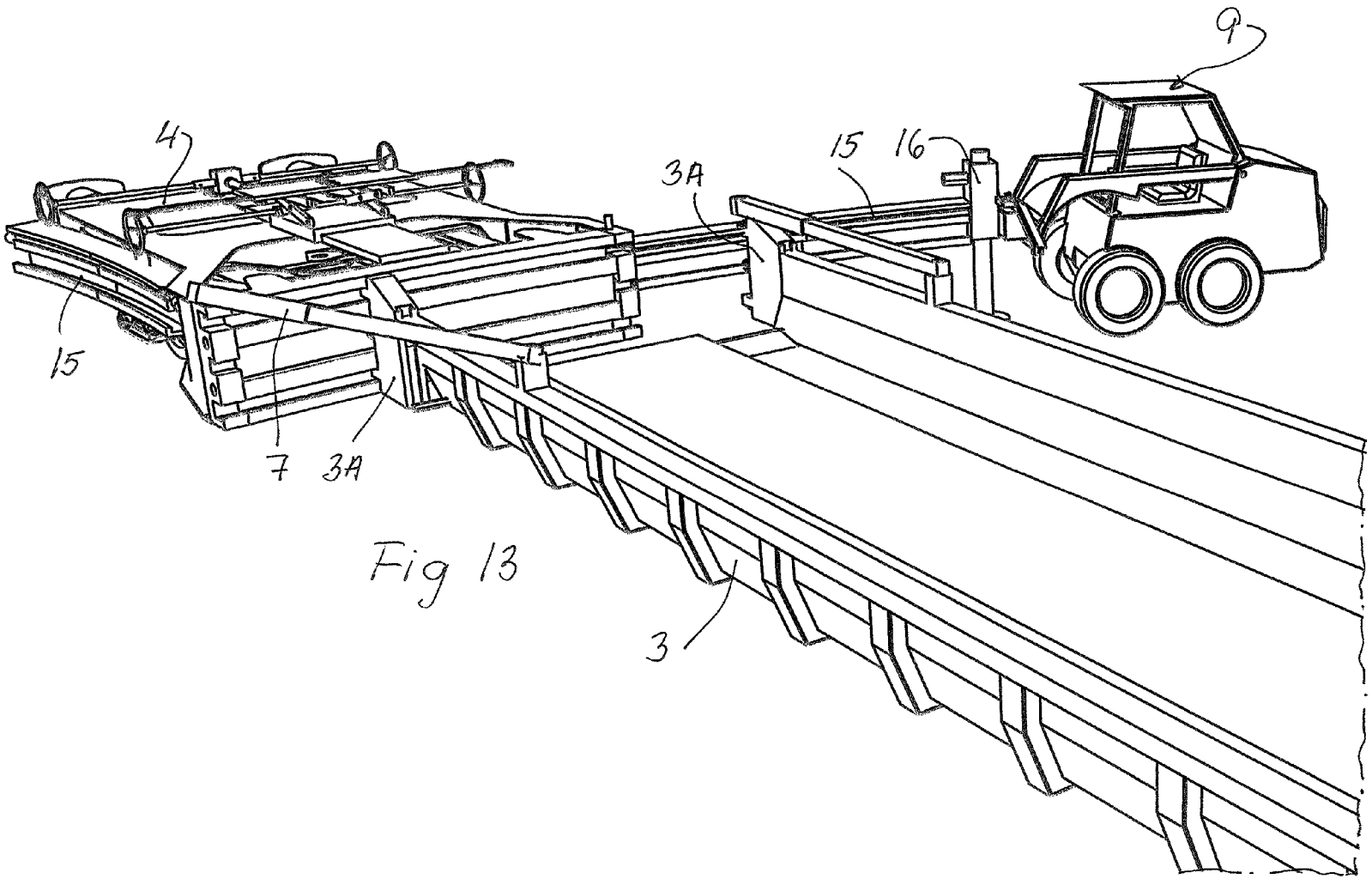
FIG. 13 is another isometric view of the wagon shown in FIG. 12 being handled by a truck.

In this embodiment the beam assembly is not separate from the wagon, but instead the wagon end 4 is provided with a beam 15, which is pivotally journaled to the wagon end and may be folded out from a rest position, as shown in FIG. 12 to a working position, as shown in FIG. 13. Each side of the wagon end 4 may be provided with such a beam 15 for enabling a pivoting out of the main portion 3 in either direction. In other respects, the beam 15 has the same general design as the beam 10 in the previous embodiment.

Figure 14:
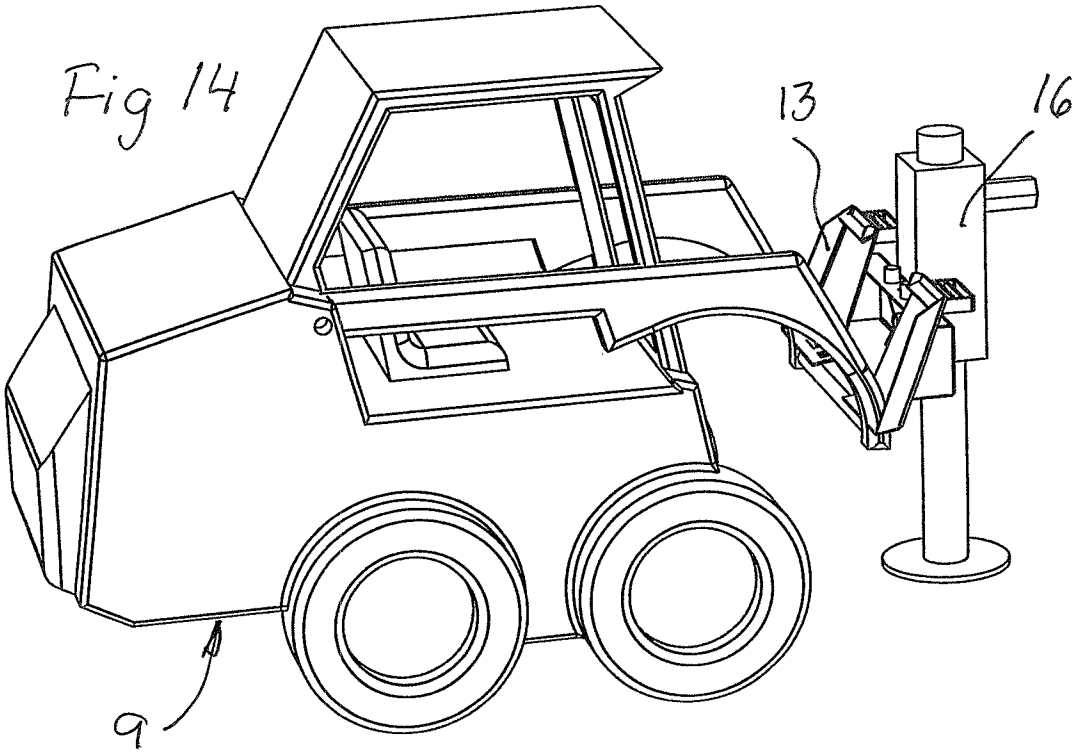
FIG. 14 is an isometric view of a truck for handling a wagon according to FIG. 12.

For the handling of the wagon at loading and unloading, a working machine or truck 9, for example of the type Bobcat®, is needed. A telescoping support leg 16 is connected to this truck 9 by means of connection means 13, as shown in FIG. 14. The support leg 16 is connected to the beam 15, as shown in FIG. 13, for maneuvering by hydraulic power from the truck.

The design of the wagon according to this second embodiment is in other respects generally the same as for the wagon according to the first embodiment. Especially, it can be noted that also this wagon is provided with the connection mechanisms 3A for lifting and lowering the main portion 3.

Figure 15:
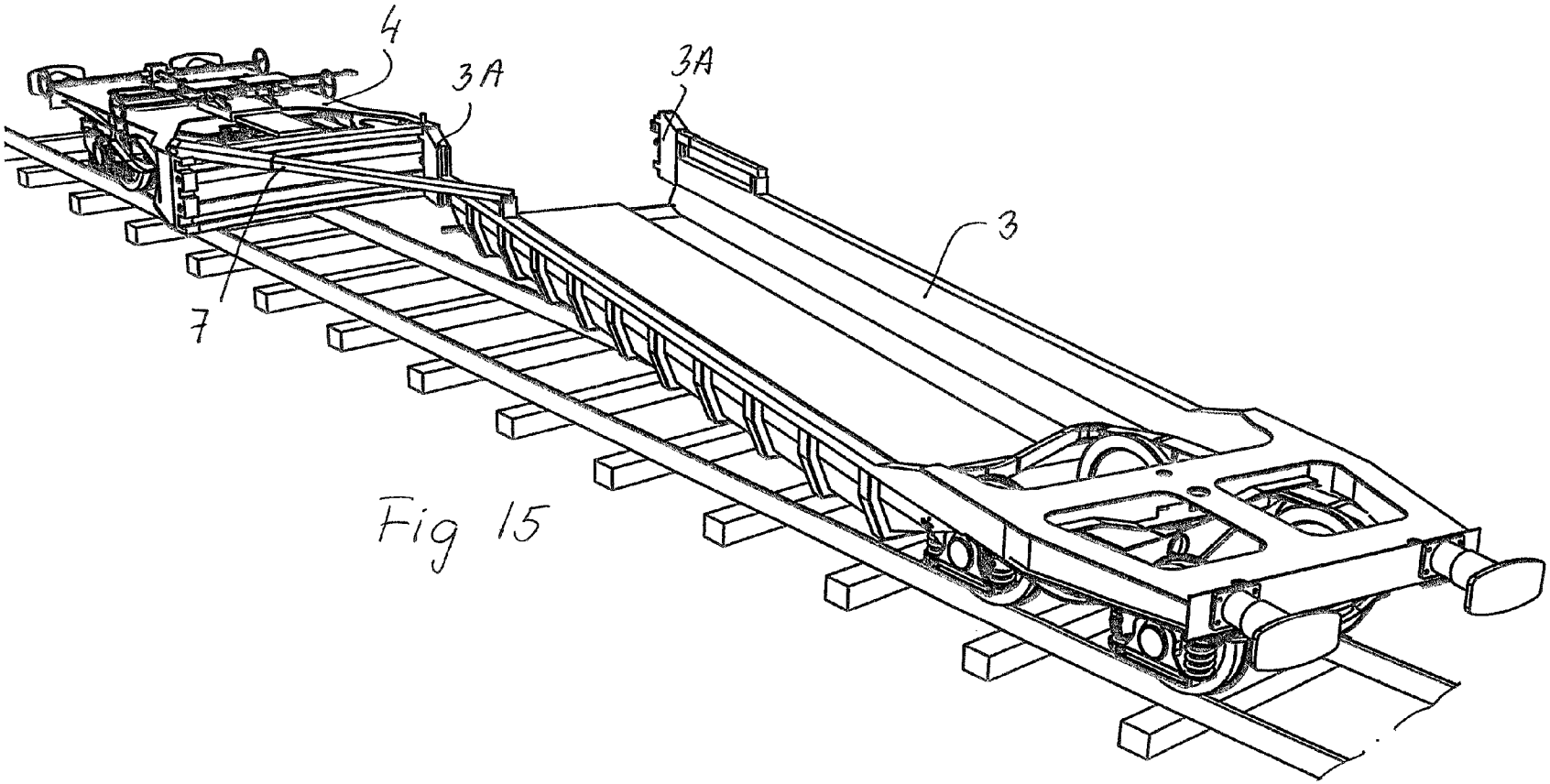
FIG. 15 is an isometric view corresponding to FIG. 13 but shows a later handling stage.

The function of the wagon is virtually the same as for the first embodiment, and therefore no detailed description is given. The function is illustrated in FIGS. 12, 13, and 15.

A third embodiment is shown in FIGS. 16-21. The main difference in relation to the previous embodiments, especially the one shown in FIGS. 12-15, with which it has the closest similarities, is that the power for handling the wagon is not provided externally, such as from the truck 9, but rather internally, such as an arrangement driven by electricity or by an internal combustion engine, preferably located in the wagon end 4. Pneumatic pressure available in a goods train can also be employed. As is well known to any person skilled in the art, such an arrangement for handling the wagon may for example be electro-mechanical, hydraulic or pneumatic with respective pros and cons.

Figure 16:
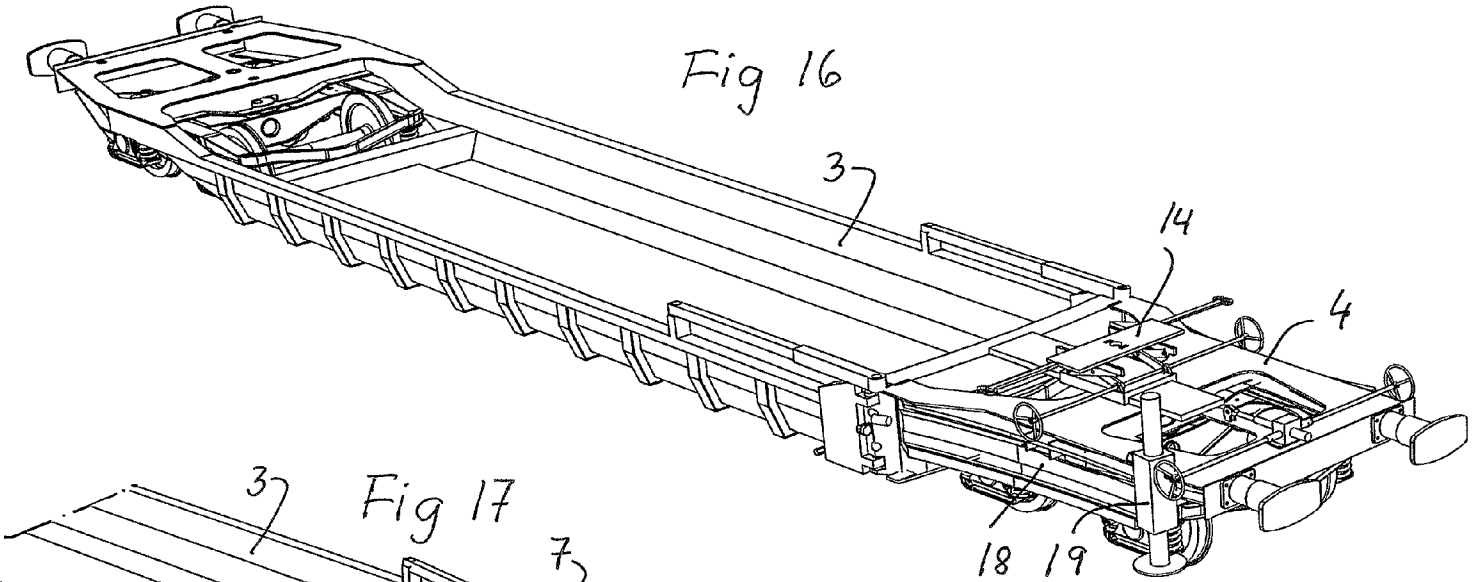
FIG. 16 is an isometric view of a semi-trailer wagon according to a third embodiment of the invention FIG. 17 corresponds to FIG. 16 but shows a handling stage with a beam pivoted out from the wagon end, FIG. 18 corresponds to FIG. 16 but shows a later handling stage with the main portion of the wagon pivoted out in the beam and lowered, FIG. 19 corresponds to FIG. 18 but with the beam pivoted in against the wagon end, FIG. 20 corresponds to FIG. 19 but with a semi-trailer placed on the main portion of the wagon.

FIG. 16 shows a wagon with an internal power source in a transport position.

Figure 17:
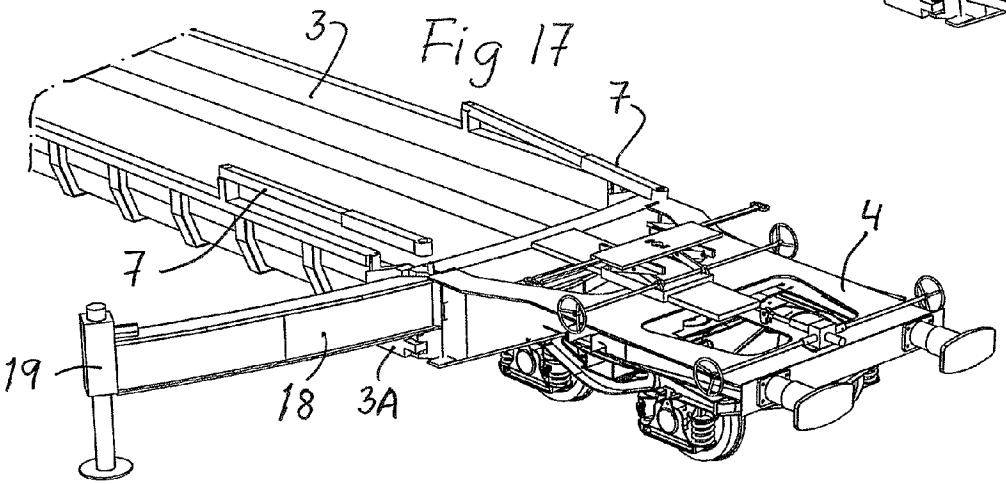

In FIG. 17 a beam 18 has been pivoted out from its rest position (FIG. 16) against the wagon end 4. A jack 19 at the beam end has been operated into supporting contact with the ground. The main portion 3 has been lifted somewhat by the connection mechanisms 3A for unlocking the latter from the wagon end 4, and the strut 7 at the beam 18 has been disconnected from the wagon end 4.

Figure 18:
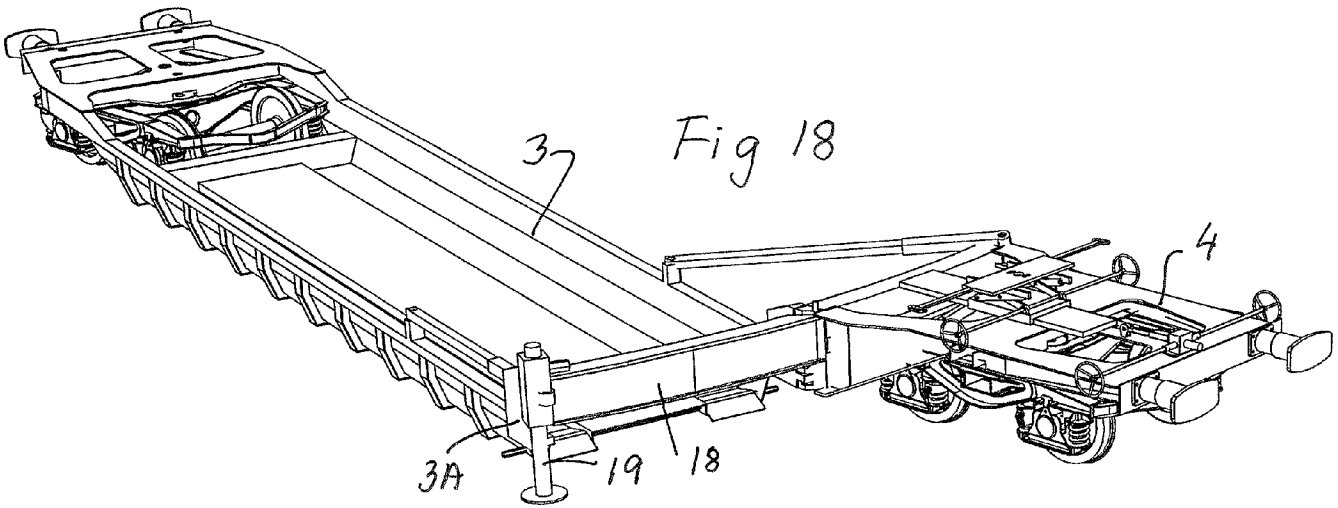

In FIG. 18 the main portion 3 has been pivoted out in the beam 18 (with its inner end still supported by the wagon end 4), and the main portion 3 has been lowered into contact with the ground by the connection mechanisms 3A.

Figure 19:
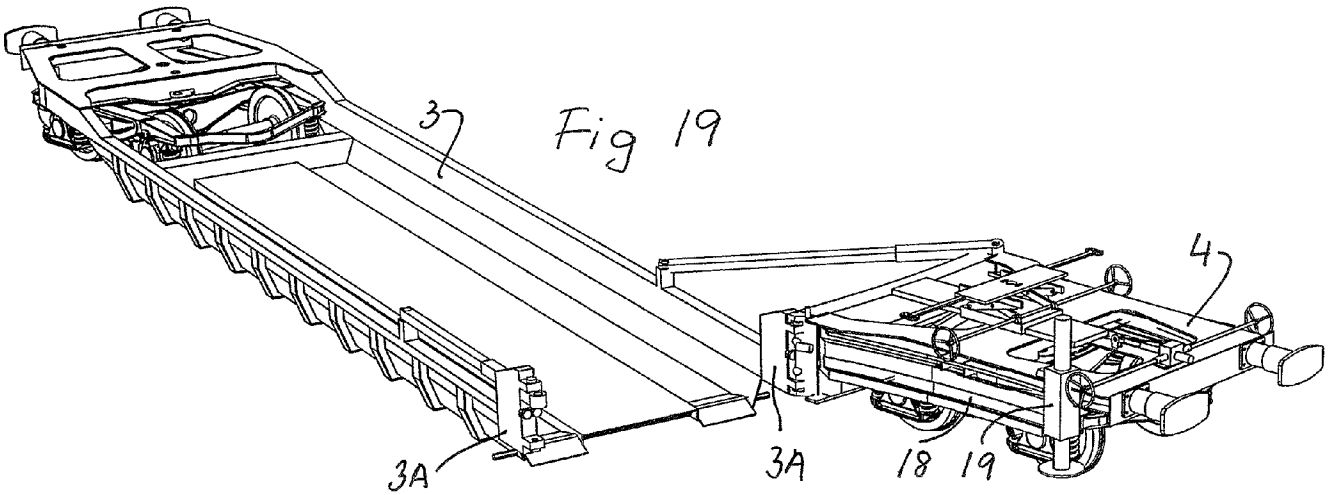

In FIG. 19 the jack 19 has been lifted from the ground, and the beam 18 has been swung in to its rest position against the wagon end 4, so that the main portion 3 can be accessed from its free end.

Figure 20:
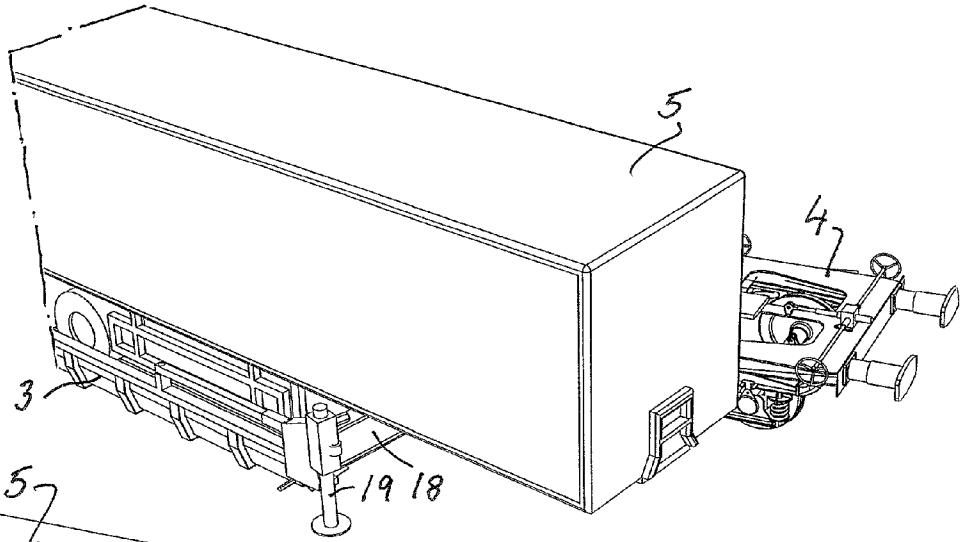

In FIG. 20 a semi-trailer has been backed onto the main portion 3, and the beam 18 has again been pivoted out from the wagon end 4 and the jack 19 been lowered into contact with the ground.

Figure 21:
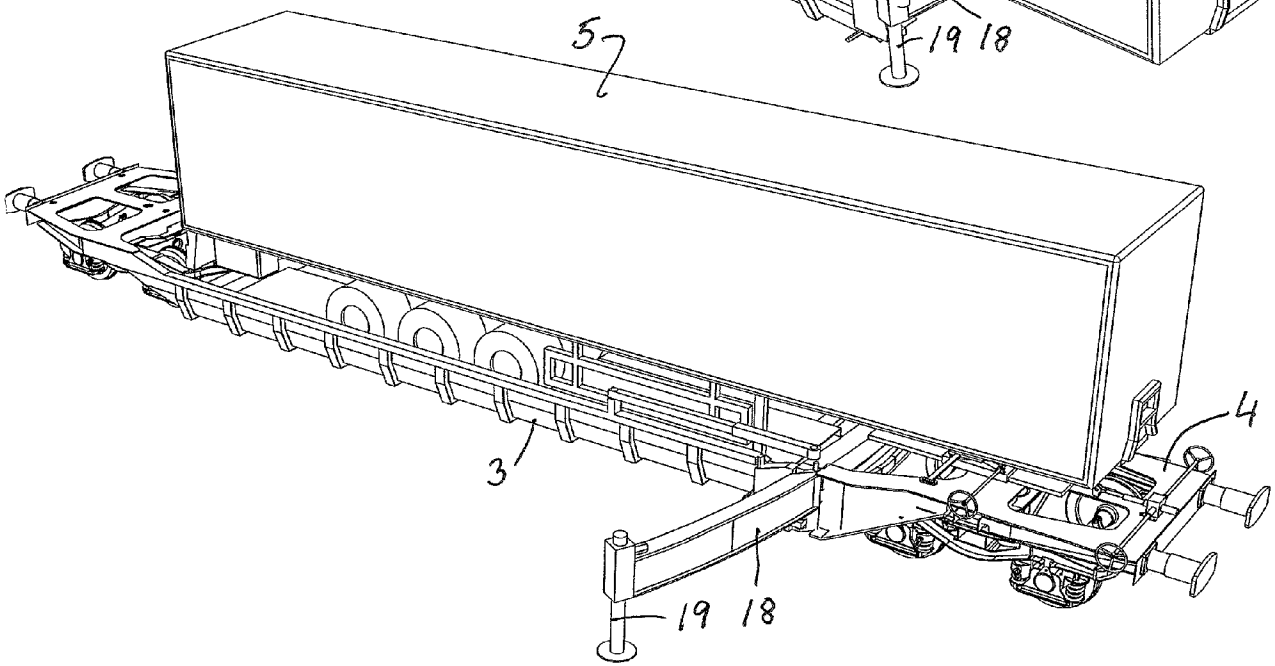
FIG. 21 shows the wagon of FIG. 16 with the beam pivoted out and with a semi-trailer on the wagon.

In FIG. 21 the main portion 3 has been pivoted back into rest position in the beam 18, and the main portion 3 has been lifted, so that locking can be effected. The king pin of the semi-trailer may engage its attachment 14 (FIG. 16) on the wagon end 4. The only remaining action before transport is to lift the jack 19 from the ground and to swing the beam 18 back into transport position against the wagon end 4.

Figure 22:
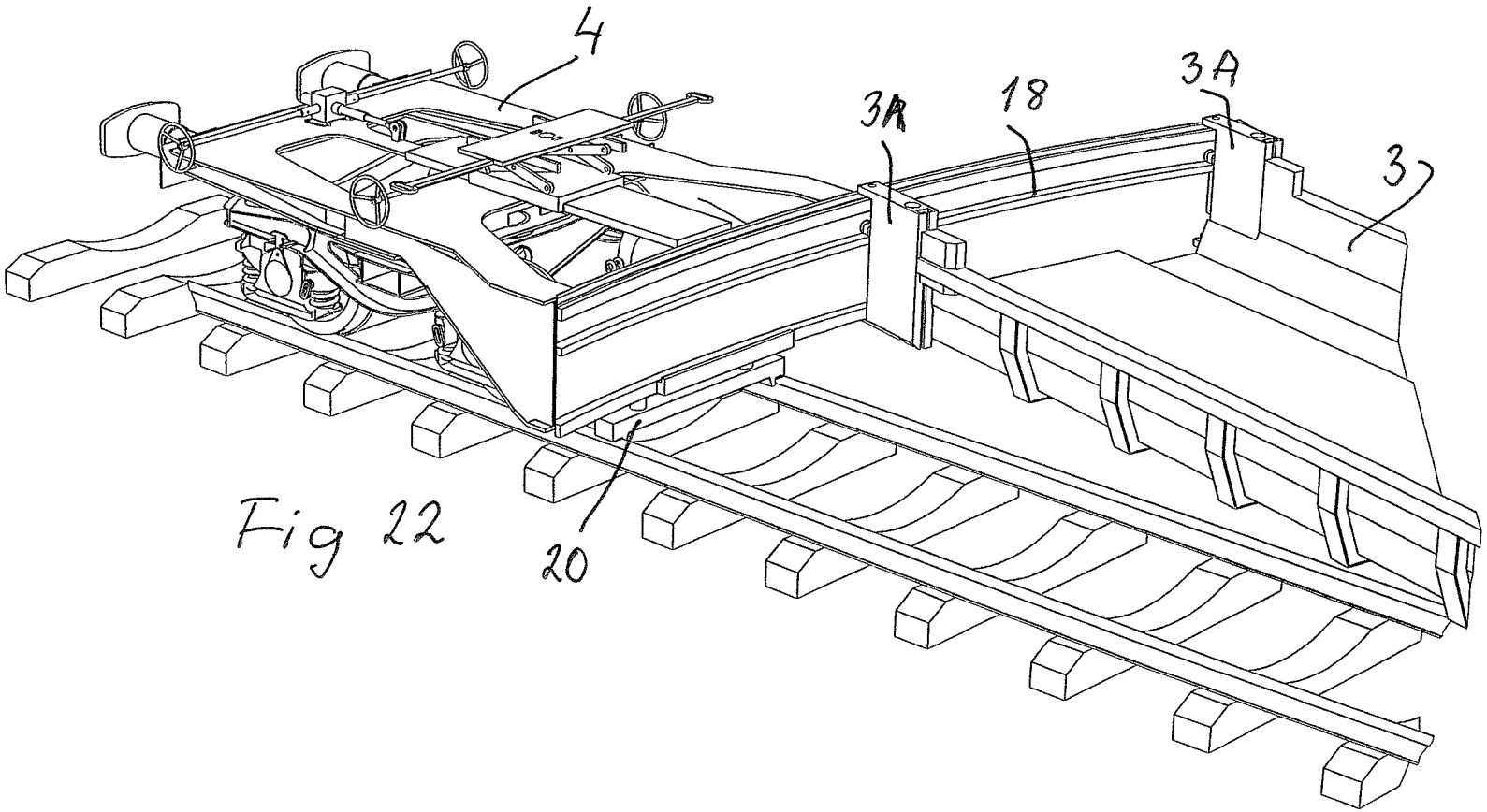
FIG. 22 is an isometric view of a modification of the wagon shown in FIG. 16.
Figure 23:
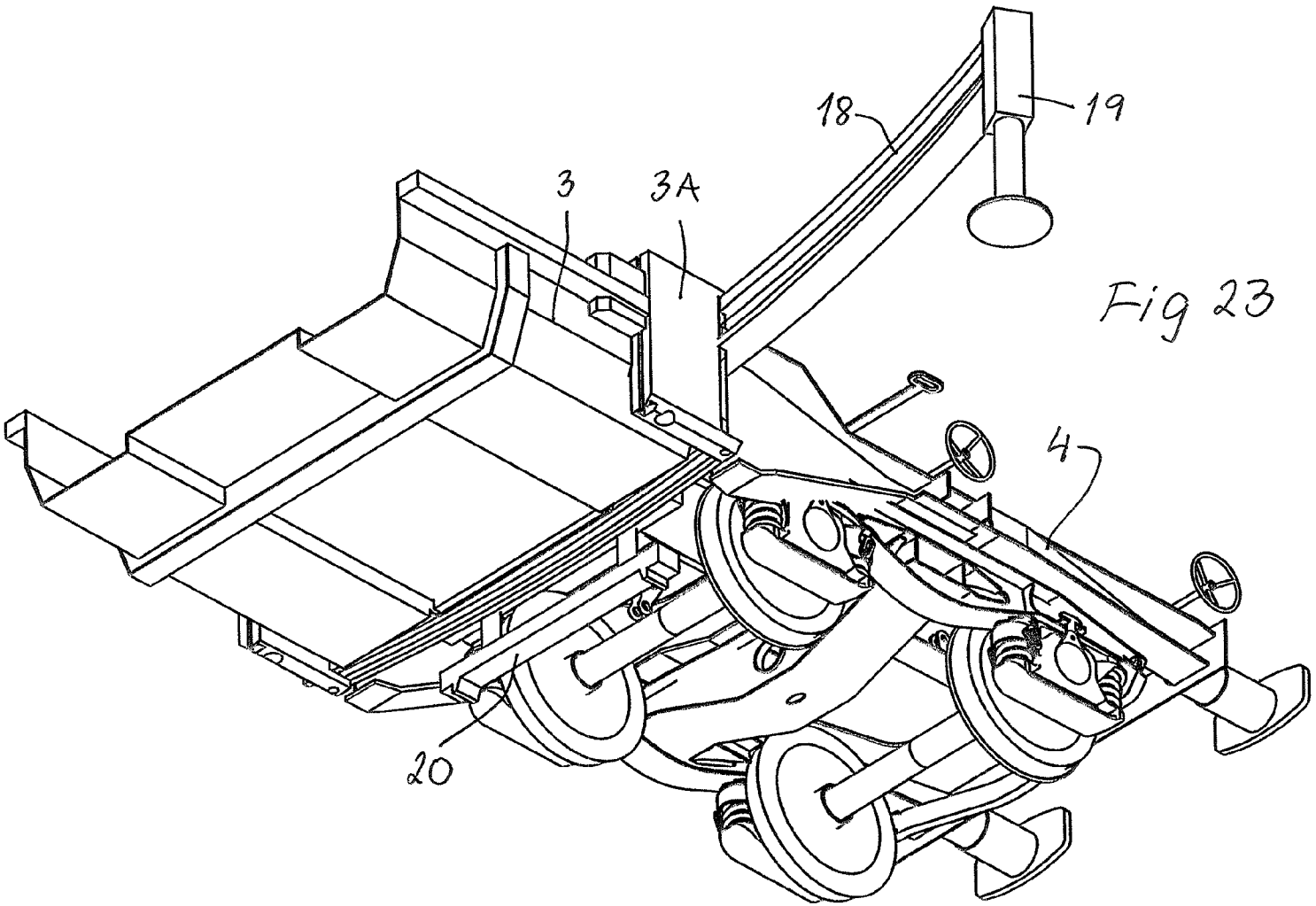
FIG. 23 is an isometric view from below of the modification shown in FIG. 22.

A modification, mainly applicable to the third embodiment of FIGS. 16-21 but in principle also applicable to the other embodiments, is shown in FIGS. 22 and 23. In the previous embodiments, stabilizing struts 7 are provided between the main portion 3 and the wagon end 4. In the present modification a stabilizing function is instead provided by a support yoke 20 applied downwards against the rail by means (not shown) in the wagon end 4 at the handling of the wagon in the way described above.

Figure 24:
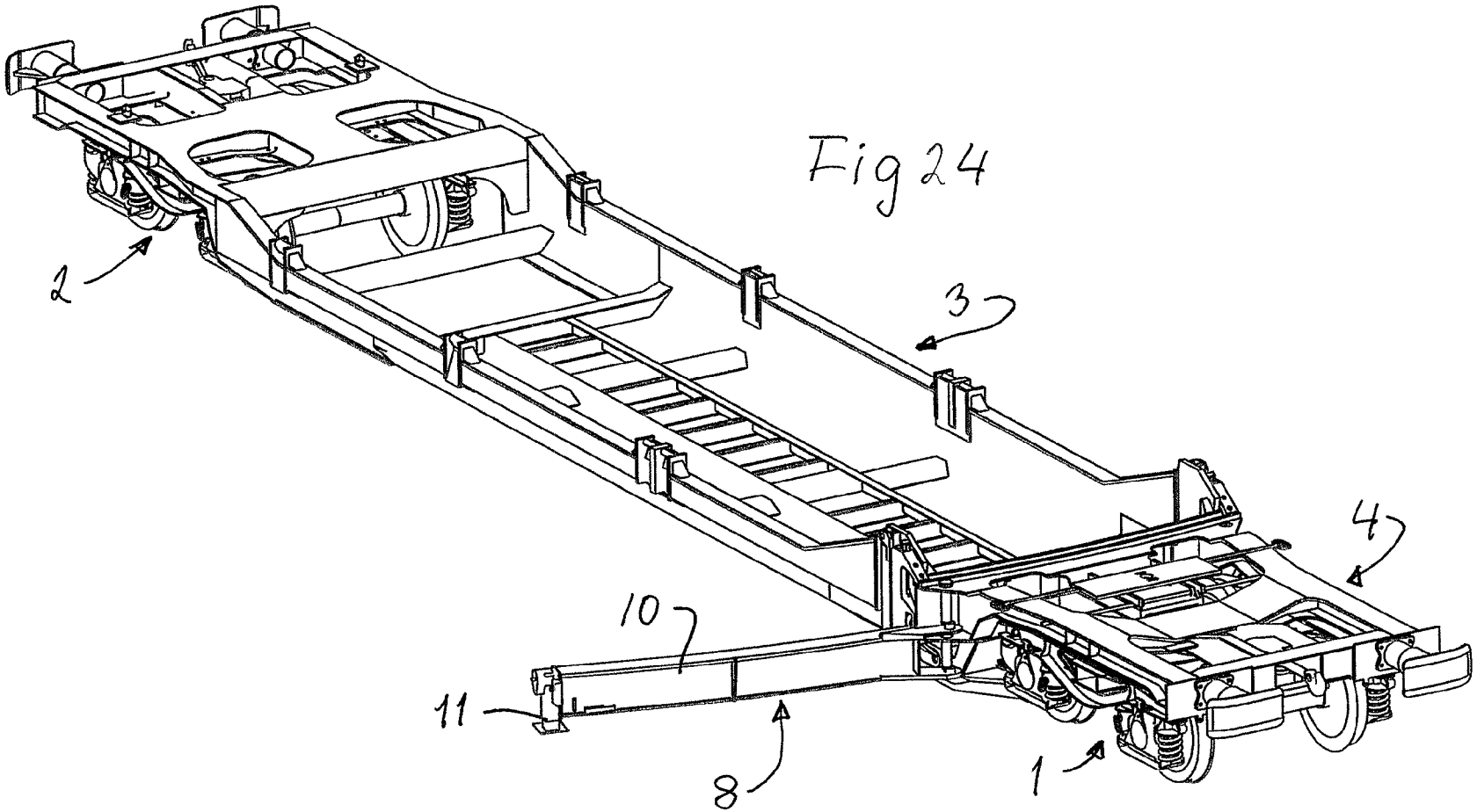
FIG. 24 is an isometric view of a semi-trailer wagon according to a fourth embodiment of the invention.

Another, slightly different railway wagon for loading a semi-trailer thereon is shown in FIG. 24. Also this wagon has two bogies (or wheel sets): a forward bogie 1 and a rearward bogie 2. The bogies 1 and 2 support a chassis, comprising a main portion 3 and a wagon end 4. As is first clearly visible in FIG. 25 but then also in many other of FIGS. 26-30, the main portion 3 and the wagon end 4 are movable in relation to each other, but in the transport position shown in FIG. 24 they are connected to each other and form an entity (or wagon that can be run on the railway). The main portion 3 is pivotally connected to the rearward bogie 2, whereas the wagon end 4 is pivotally connected to the forward bogie 1.

The main portion 3 is intended to accommodate a semi-trailer (not shown) and is preferably through-shaped with an open end when pivoted out from the wagon end 4 and with longitudinal sidewalls.

The relative movability of the main portion 3 in relation to the wagon end 4 has the purpose of enabling a rolling loading of the semi-trailer 5 onto the main portion 3 in a position where the main portion 3 is pivoted out from the wagon end 4.

At the arc-shaped junction between the main portion 3 and the wagon end 4 there is a slide arrangement to enable the pivoting movement and locking means to lock the main portion 3 to the wagon end 4 in a transport position. The slide arrangement may comprise grooves in the wagon end 4 and projections 6 (see especially FIG. 28A) at each end of the main portion 3.

In order to enable the pivoting out of the main portion 3 to a position, in which a semi-trailer can be rolled onto the main portion, there is provided a beam assembly 8, preferably hydraulically powered and controlled.

This beam assembly 8 mainly comprises an arc-shaped beam 10 with a telescoping support leg 11 extending perpendicularly thereto. The support leg 11 may be telescoped to a desired length by a hydraulic motor therein.

Figure 28:
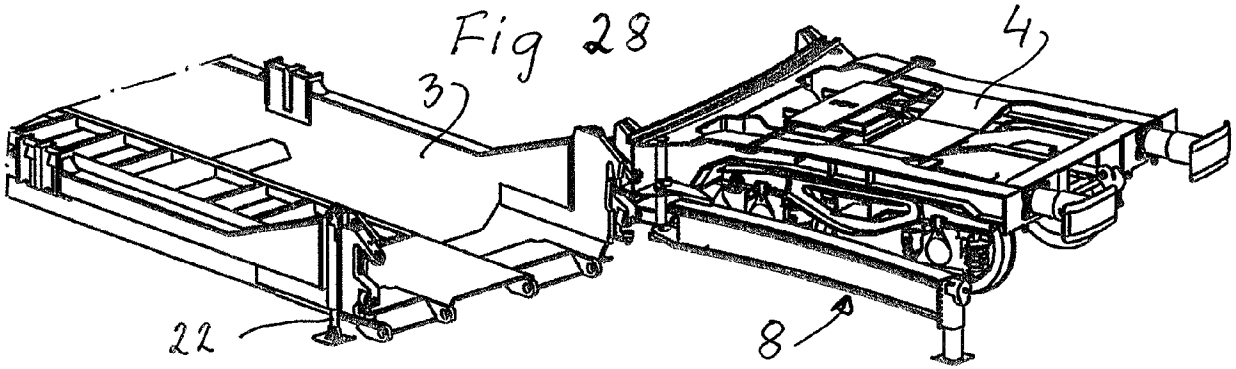
FIG. 28A is a detail view from FIG. 28.
Figure 28A:
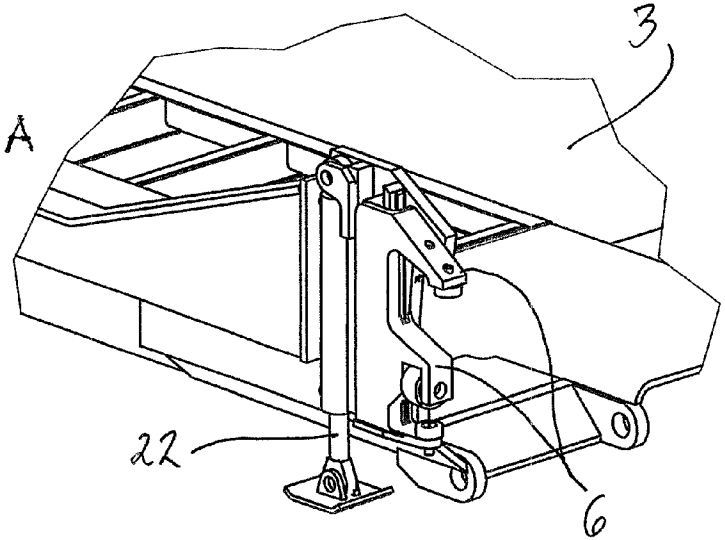

As is most clearly shown in FIG. 28A, the main portion 3 is at each side provided with a telescoping control leg 22, preferably hydraulically operated.

Hydraulic means are provided for pivoting the main portion 3 in relation to the wagon end 4 between a transport position shown in FIG. 24 (although the beam assembly 8 is folded in against the wagon end 4 in that position) and a loading and unloading position shown in FIGS. 25-28.

For powering the different hydraulic means on the wagon the wagon may be provided with an on-board hydraulic power source.

FIG. 24 illustrates a position in which the beam assembly 8 has been folded out from its transport position against the wagon end 4, whereas the main portion 3 is still in the transport position.

Figure 25:
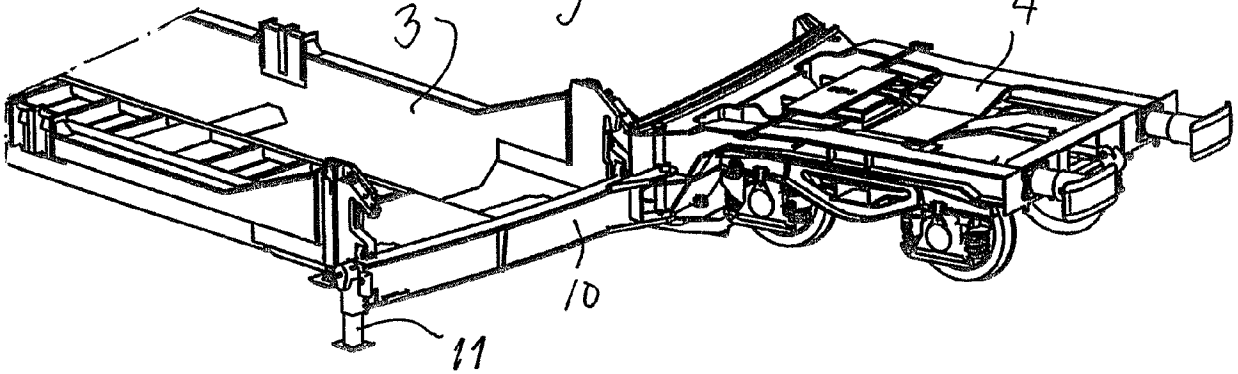
FIG. 25 is an isometric view of a part of the wagon shown in FIG. 24 in a later stage in the handling of the wagon, FIG. 26 corresponds to FIG. 25 but shows a further stage in the handling of the wagon, FIG. 27 also corresponds to FIG. 25 but shows a further handling stage, FIG. 28 also corresponds to FIG. 25 but shows a further handling stage.

In FIG. 25 the support leg 11 has been lowered into supporting contact with the ground, and the main portion 3 has been pivoted out from the wagon end 4.

Figure 26:
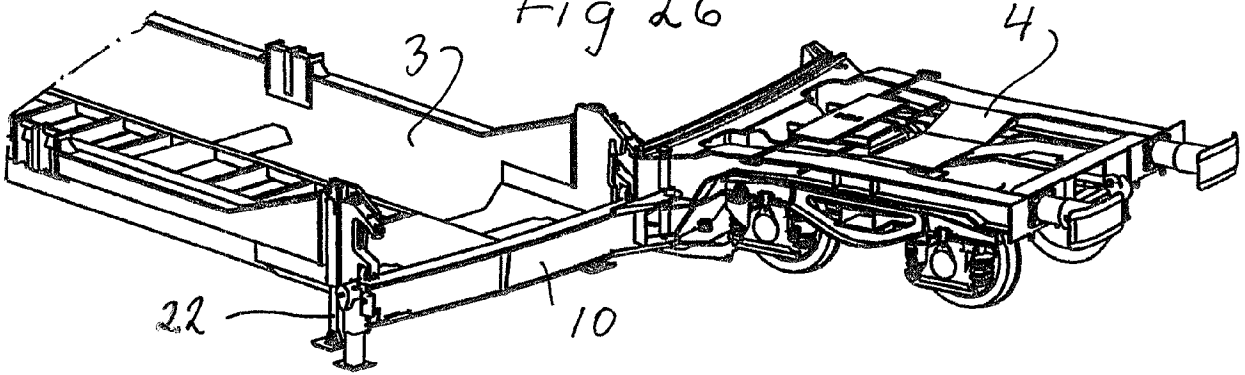

In FIG. 26 the control legs 22 have been lowered into contact with the ground and also lifted the main portion 3 somewhat out of engagement with the beam 10.

Figure 27:
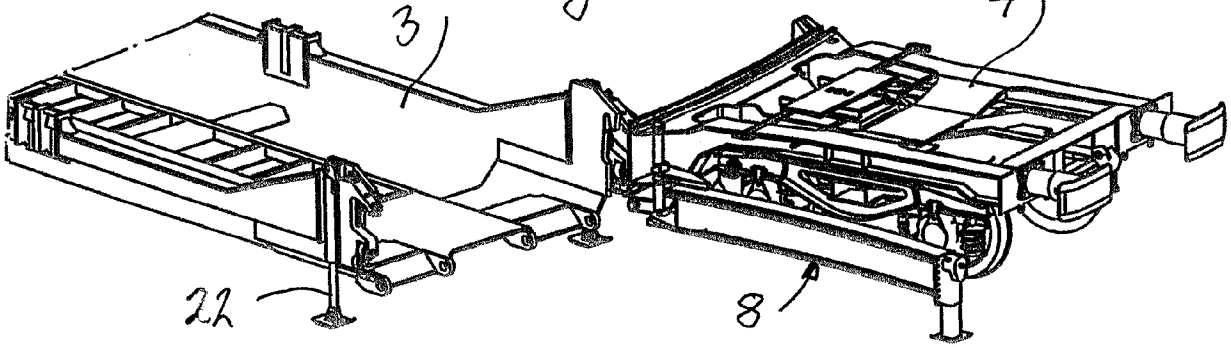

In FIG. 27 the beam assembly 8 has been folded in against the wagon end 4, and in FIG. 28 the control legs 22 have lowered the main portion 3 down to the ground, so that a semi-trailer (not shown) can be backed onto the main portion.

Hereafter, the operation is basically reversed, so that the wagon reaches the position shown in FIG. 24, whereupon the beam assembly is folded in against the wagon end 4, so that the wagon can be transported along its rail.

Figure 30:
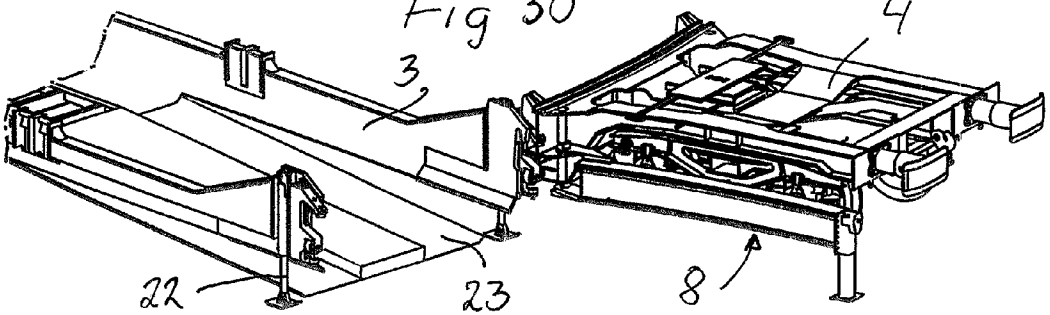
FIG. 30 is an isometric view of a part of the wagon shown in FIG. 29 in a later stage in the handling of the wagon.
Figures 29, 29A:
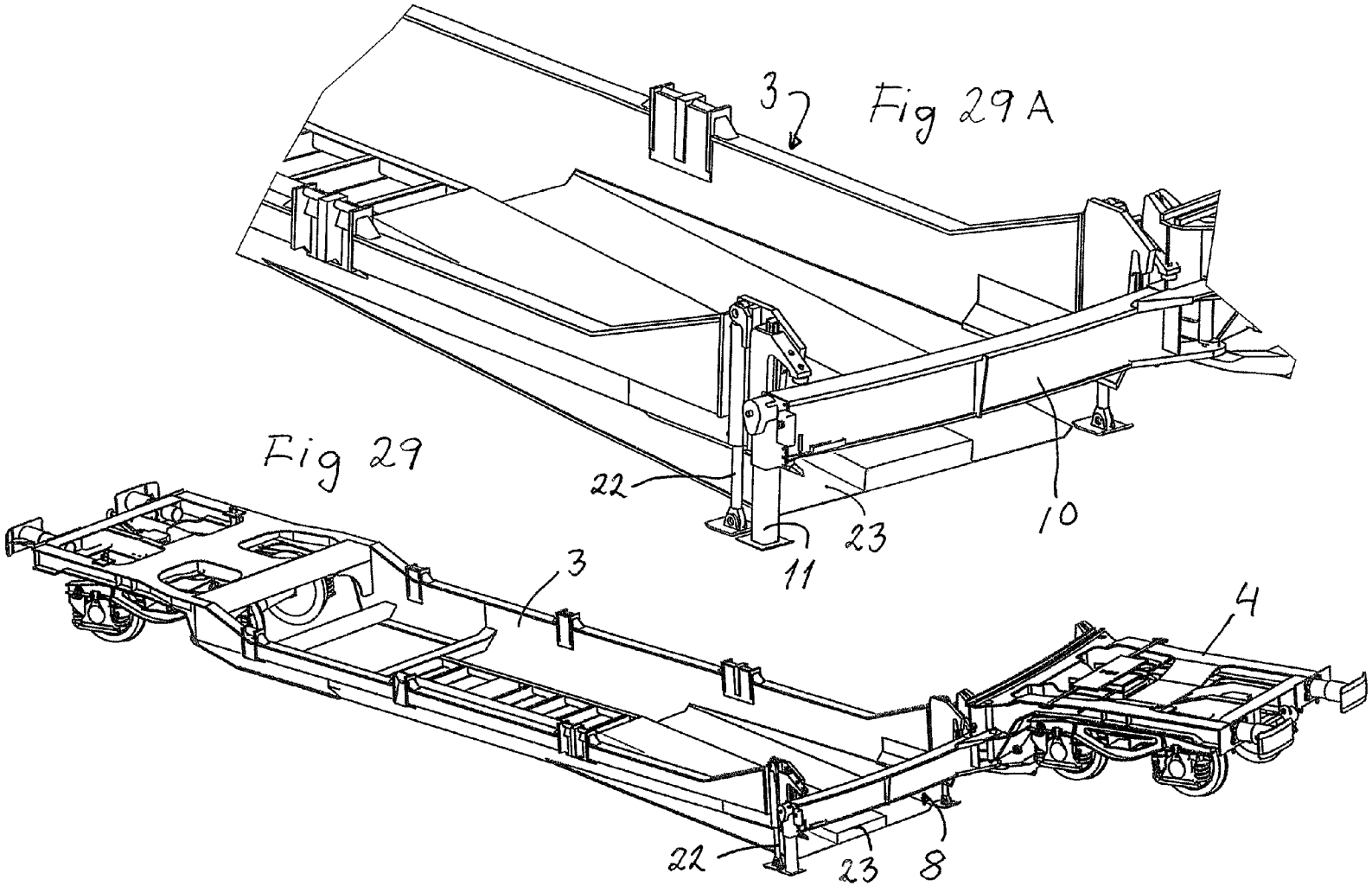
FIG. 29 is an isometric view of a semi-trailer wagon according to a fifth embodiment of the invention.
FIG. 29A is a detail view from FIG. 29.

A fifth embodiment of the wagon according to the invention is shown in FIGS. 29, 29A, and 30. This embodiment has many similarities with the fourth one, and like numerals are used for like parts.

The difference is mainly that in the fifth embodiment the main portion 3 is provided in its end facing the wagon end 4 or its end pivoting out therefrom with a bottom ramp 23, pivotally attached the remaining bottom of the main portion 3. This ramp 23 is connected to the control legs 22, so that when these are lowered to the ground, also the bottom ramp 23 is lowered, enabling a semi-trailer to be backed onto the main portion 3, which otherwise remains in its horizontal position.

Alternatively—but not shown—the control legs 22 downwardly end in the bottom ramp 23, so that it is the bottom ramp that is lowered to the ground.

A sixth embodiment of the wagon according to the invention is shown in FIGS. 31-36. This embodiment has basic similarities with the embodiments shown in FIGS. 24-30 in that the wagon preferably is provided with at least one on-board power source and hydraulic means for operation of the wagon. However, this wagon may alternatively be constructed in the same way as the embodiments shown in FIGS. 1-23, where power for the operation of the wagon is externally provided.

The previously shown and described semi-trailer wagons are each provided with two bogies, one towards each end. However, it is not uncommon that two (or even more) such wagons are coupled together into a wagon unit by means of a special common bogie, called a Jacobs bogie. FIGS. 31-36 thus illustrate a six-axle wagon with a two-axle bogie towards each end and a two-axle Jacobs bogie 30 in the middle. This wagon is functionally nothing else than two "ordinary" wagons connected by a Jacobs bogie.

Figure 31:
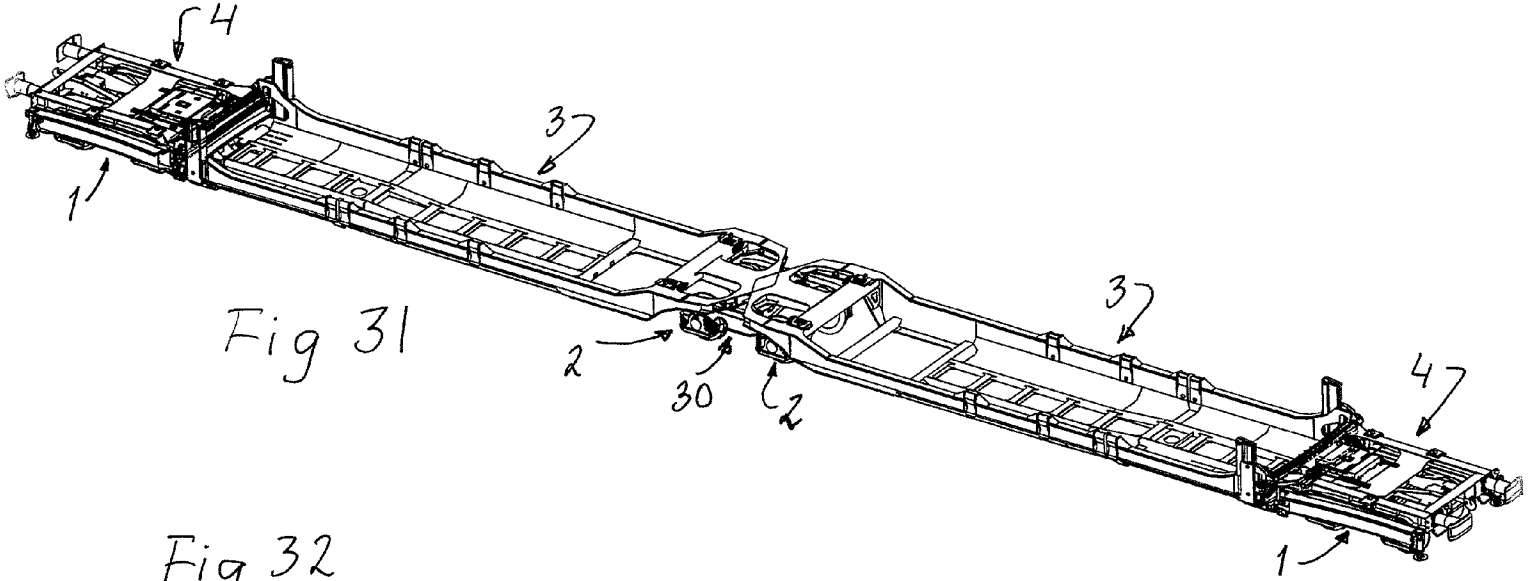
FIG. 31 is an isometric view of a semi-trailer wagon according to a sixth embodiment of the invention.
Figure 32:
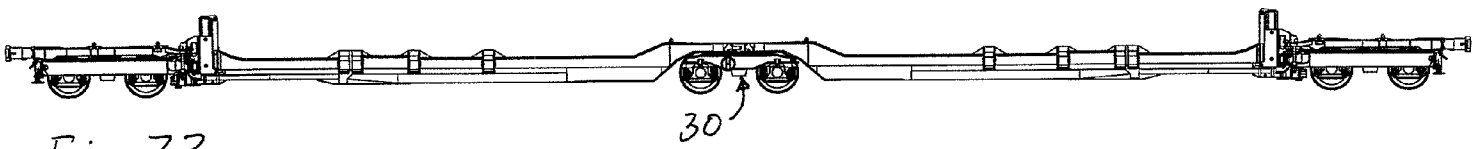
FIGS. 32 and 33 are a side view and a top view, respectively, of the wagon shown in FIG. 31, FIGS. 34 and 35 correspond to FIG. 33 and illustrate different working modes for the wagon.
Figure 33:
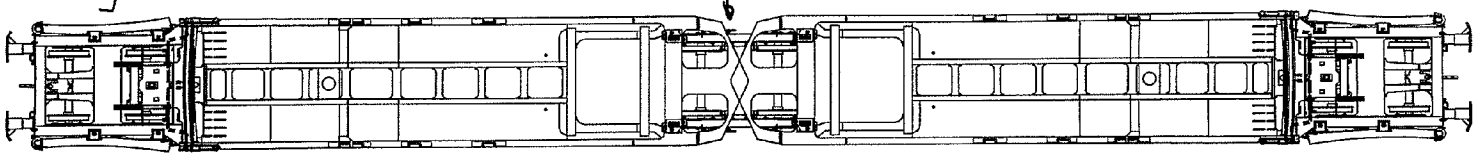
Figure 34:
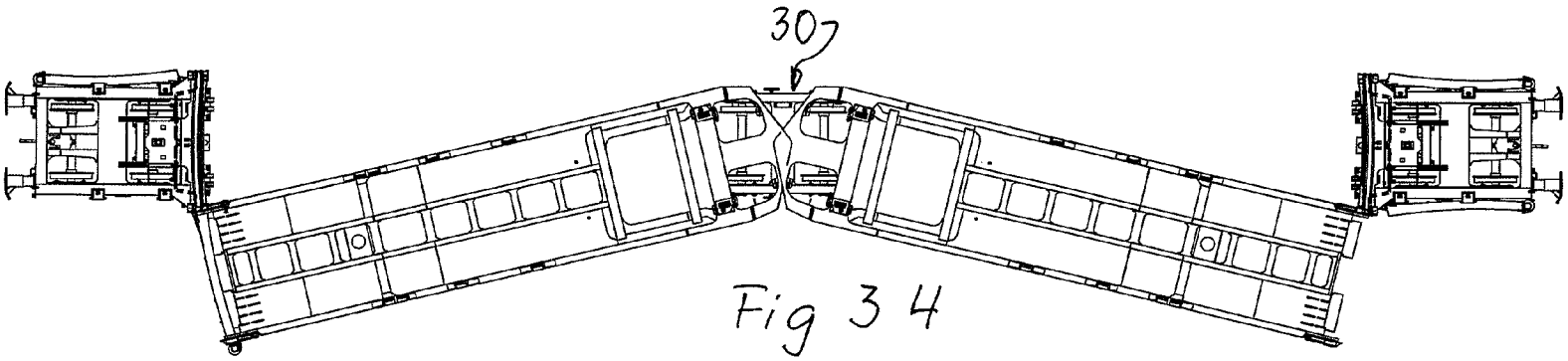
Figure 35:
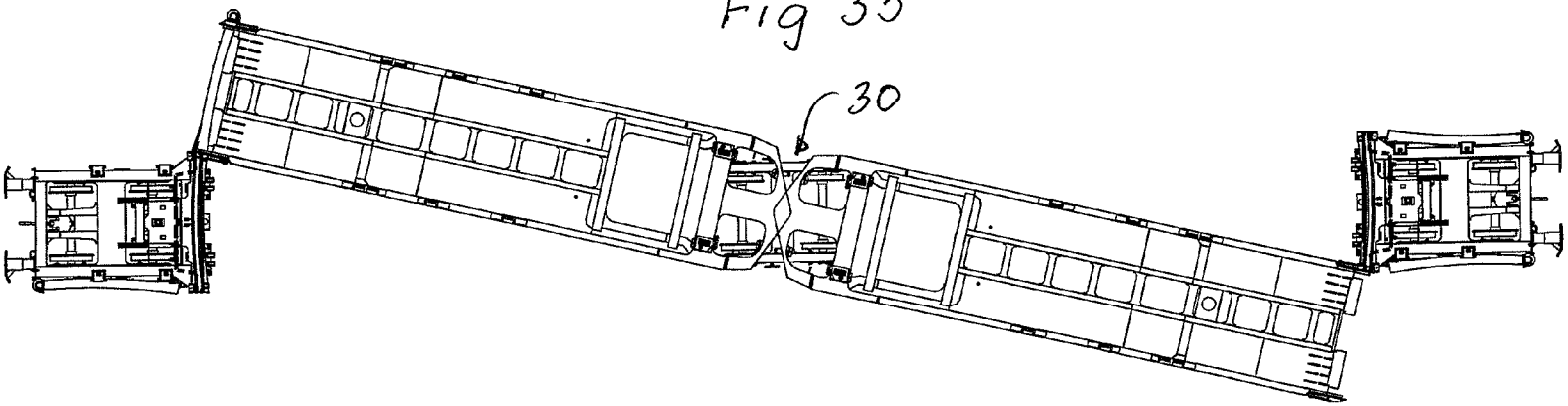

With reference to FIG. 31, each such wagon has a forward bogie 1, a rearward bogie 2 (which happens to be one and the same Jacobs bogie 30), a main portion 3, and a wagon end 4. Each main portion 3 can be pivoted out, as described above. FIGS. 34 and 35 are meant to illustrate that the two main portions 3 may be pivoted out in the same direction or in opposite directions.

Figure 36:
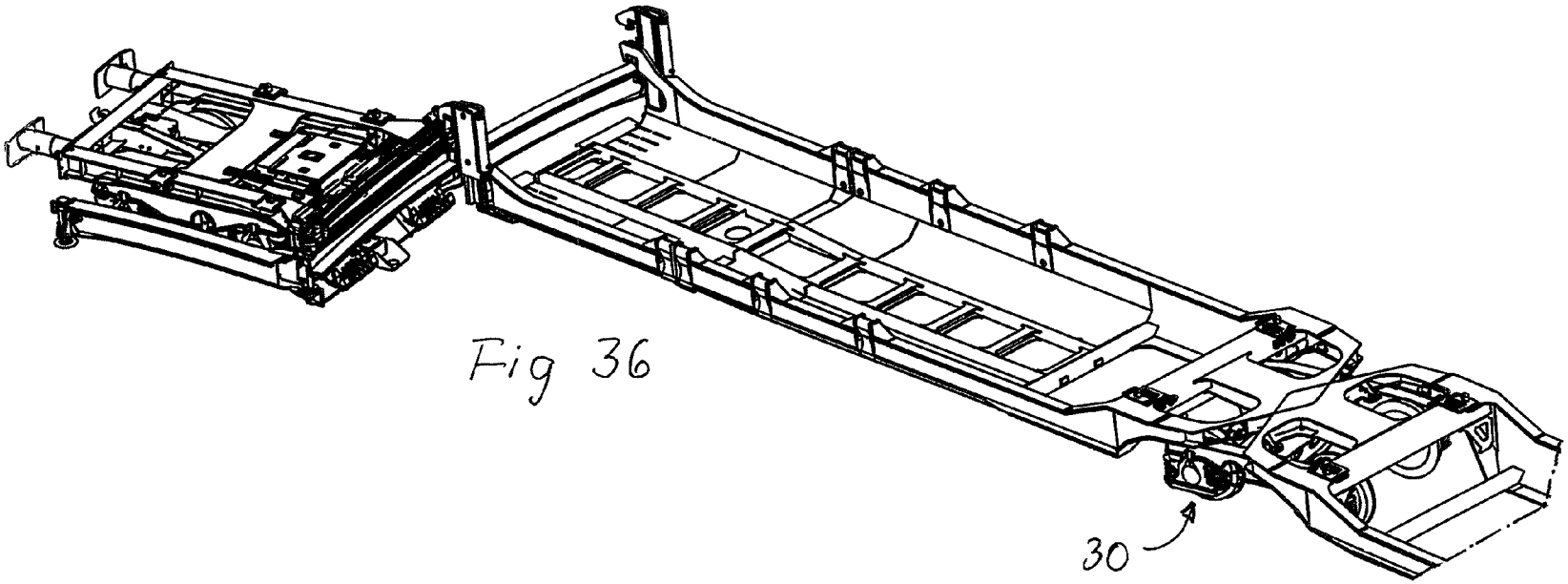
FIG. 36 is an isometric view to a larger scale of slightly more than half of the wagon of FIG. 31 in a pivoted out position.

FIG. 36 is meant to illustrate to a larger scale slightly more than a half of this wagon supported in the middle by a Jacobs bogie 30. It is evident also from this illustration that the design for pivoting out the main portion 3 generally corresponds to the design in the embodiments shown in FIGS. 24-30

Modifications are possible within the scope of the appended claims.

The invention claimed is:

1. A railway wagon comprising a main portion directly and pivotally connected to a rearward bogie and a wagon end directly connected to a forward bogie, the main portion and the wagon end being releasably connected to each other, said railway wagon further comprising:

a beam configured for pivotal connection to the wagon end and configured to horizontally guide the end of the main portion that is releasably connected to the wagon end as the main portion is pivoted, and a lift configured to vertically displace the main portion in relation to the wagon end.

2. A railway wagon according to claim 1, wherein power for maneuvering the main portion is transferred from a power source external to the wagon through the beam.

3. A railway wagon according to claim 1, wherein power for maneuvering the main portion is transferred from a power source in the wagon.

4. A railway wagon according to claim 2, wherein a beam assembly comprising the beam and two telescoping support legs is configured for connection to a working machine or truck.

5. A railway wagon according to claim 2, wherein the beam is pivotally attached to the wagon end and is configured to be connected to a working machine or truck.

6. A railway wagon according to claim 5 and further comprising in combination therewith a working machine or truck is including a telescoping support leg for the beam.

7. A railway wagon according to claim 3, wherein the beam is pivotally attached to the wagon end includes a telescoping support leg at the end of the beam not attached to the wagon end.

8. A railway wagon according to claim 1, wherein a connection mechanism between the main portion and the wagon end comprise the lift for vertically displacing the main portion in relation to the wagon end.

9. A railway wagon according to claim 8, wherein a connection mechanism is at each lateral end of the main portion.

10. A railway wagon according to claim 9, wherein each connection mechanism is configured to lift the main portion from a locked neutral position in order to unlock the connection mechanism from the wagon end and for lowering the main portion to the ground.

11. A railway wagon according to claim 1, comprising telescoping control legs on the main portion configured to support the main portion on the ground, when the main portion is pivoted out from the wagon end and disconnected from the beam.

12. A railway wagon according to claim 11, wherein the control legs are near the end of the main portion and are releasably connected to the wagon end.

13. A railway wagon according to claim 12, wherein the control legs are configured to lower the main portion to the ground and to lift the main portion again after loading or unloading of a semi-trailer.

14. A railway wagon according to claim 12, wherein the control legs are configured to lower a bottom ramp, pivotally attached to the main portion, to the ground and to lift the bottom ramp again after loading or unloading of a semi-trailer.

15. A railway wagon according to claim 12, wherein power for maneuvering the main portion and the control legs is transferred from a power source in the wagon.

16. A railway wagon according to claim 11, wherein the beam includes a support leg to support the beam against the ground.

17. A wagon unit comprising two railway wagons of claim 1 on a common Jacobs bogie that constitutes the rearward bogie for each of the two railway wagons.

18. A method for loading a semitrailer on a railway wagon comprising a main portion directly and pivotally connected to a rearward bogie and a wagon end directly connected to a forward bogie, the main portion and the wagon end being releasably connected to each other, said method comprising:

pivoting a beam out from the wagon end in proper position for horizontally guiding the main portion, pivoting the main portion out from the wagon end while guiding the main portion with the beam, lowering the main portion to vertically displace the main portion in relation to the wagon end, and removing the beam or pivoting the beam in against the wagon end for allowing longitudinal entry of the semi-trailer on the railway wagon.

19. A method according to claim 18, wherein the main portion of the railway wagon includes telescoping control legs on the main portion, the method further comprising:

lowering the main portion into supporting contact with the ground using the telescoping control legs prior to removing the beam or pivoting the beam in against the wagon end.

20. A method according to claim 19, the railway wagon further comprising a bottom ramp pivotally attached to the main portion, the method further comprising lowering the bottom ramp to the ground together with the control legs.

* * * * *